US012310418B2

(12) United States Patent
Blattler et al.

(10) Patent No.: US 12,310,418 B2
(45) **Date of Patent: *May 27, 2025**

(54) CARTRIDGE ASSEMBLY FOR AN AEROSOL-GENERATING SYSTEM WITH LEAK PREVENTION

(71) Applicant: Altria Client Services LLC, Richmond, VA (US)

(72) Inventors: Olivier Blattler, Fribourg (CH); Guillaume Frederick, Les-Geneveys-sur-Coffrane (CH); Pascal Manuel Loser, Liebefeld (CH); Guido Peter Schellenberg, Niederlenz (CH); Patrick Charles Silvestrini, Neuchatel (CH); Dominique Paul Gabriel Stohr, Belfaux (CH); Ihar Nikolaevich Zinovik, Peseux (CH)

(73) Assignee: Altria Client Services LLC, Richmond, VA (US)

( * ) Notice: Subject to any disclaimer, the term of this patent is extended or adjusted under 35 U.S.C. 154(b) by 72 days.

This patent is subject to a terminal disclaimer.

(21) Appl. No.: 18/303,970

(22) Filed: Apr. 20, 2023

(65) Prior Publication Data

US 2023/0255262 A1 Aug. 17, 2023

Related U.S. Application Data

(63) Continuation of application No. 16/172,195, filed on Oct. 26, 2018, now Pat. No. 11,653,699, which is a (Continued)

(30) Foreign Application Priority Data

Oct. 26, 2017 (EP) ..... 171987043

(51) Int. Cl.
*A24F 40/60* (2020.01)
*A24D 3/17* (2020.01)
(Continued)

(52) U.S. Cl.
CPC ..... *A24F 40/60* (2020.01); *A24D 3/17* (2020.01); *A24F 40/42* (2020.01); *A24F 40/485* (2020.01); *A24F 40/10* (2020.01); *A24F 40/46* (2020.01)

(58) Field of Classification Search
CPC ..... A24F 40/10; A24F 40/42; A24F 40/485
See application file for complete search history.

(56) References Cited

U.S. PATENT DOCUMENTS 9,687,029 B2 6/2017 Liu
10,863,775 B2 12/2020 Silvestrini
(Continued)

FOREIGN PATENT DOCUMENTS

CN 104602552 A 5/2015
CN 204599324 U 9/2015
(Continued)

OTHER PUBLICATIONS

Kwon, Machine translation KR_20130106009 (Year: 2013).*
(Continued)

*Primary Examiner* — Michael H. Wilson
*Assistant Examiner* — Stephanie Lynn Moore
(74) *Attorney, Agent, or Firm* — Harness, Dickey & Pierce, P.L.C.

(57) ABSTRACT

A cartridge assembly for an aerosol-generating system including a housing having an air outlet and an air inlet upstream of the housing air outlet; and a cartridge disposed within the housing. The cartridge includes a fluid-permeable heating element within a cartridge body; a cartridge air inlet; a cartridge air outlet; and an airflow path extending from the
(Continued)

cartridge air inlet to the cartridge air outlet, via the fluid-permeable heating element. At least a portion of the cartridge may move between a first position, in which air from the housing air inlet is blocked from flowing to the housing air outlet, via the cartridge air inlet, the fluid-permeable heating element, and the cartridge air outlet; and a second position, in which an unrestricted airflow path exists from the housing air inlet to the housing air outlet, via the cartridge air inlet, the fluid-permeable heating element, and the cartridge air outlet.

16 Claims, 8 Drawing Sheets

Related U.S. Application Data continuation of application No. PCT/EP2018/078805, filed on Oct. 19, 2018.

(51) Int. Cl.

| | |
|---|---|
| ***A24F 40/10*** | (2020.01) |
| ***A24F 40/42*** | (2020.01) |
| ***A24F 40/46*** | (2020.01) |
| ***A24F 40/485*** | (2020.01) |

(56) References Cited

U.S. PATENT DOCUMENTS

| | | | | |
|---|---|---|---|---|
| 11,653,699 | B2 * | 5/2023 | Blattler | A24F 40/485 131/273 |
| 2013/0306065 | A1 | 11/2013 | Thorens et al. | |
| 2015/0305406 | A1 | 10/2015 | Li et al. | |
| 2016/0345630 | A1 | 12/2016 | Mironov et al. | |
| 2017/0172210 | A1 | 6/2017 | Bright et al. | |
| 2017/0280773 | A1 | 10/2017 | Force | |

FOREIGN PATENT DOCUMENTS

| | | | |
|---|---|---|---|
| CN | 205358221 | U | 7/2016 |
| CN | 206079029 | U | 4/2017 |
| CN | 106998815 | A | 8/2017 |
| CN | 106998819 | A | 8/2017 |
| CN | 107205475 | A | 9/2017 |
| CN | 206453243 | U | 9/2017 |
| KR | 2013/0106009 | A | 9/2013 |
| KR | 101774283 | B1 | 9/2017 |
| RU | 2014151427 | A | 8/2016 |
| WO | WO-2016/106500 | A1 | 7/2016 |
| WO | WO-2017/032695 | A1 | 3/2017 |
| WO | WO-2017118347 | A1 | 7/2017 |
| WO | WO-2017129616 | A1 | 8/2017 |
| WO | WO-2017129617 | A1 | 8/2017 |
| WO | WO-2019/081384 | A1 | 5/2019 |

OTHER PUBLICATIONS

Liu, Machine translation WO_2016106500_A1 (Year: 2016).*
Chinese Office Action dated May 31, 2023 for corresponding Chinese Patent Application No. 201880068988.1.
Japanese OA dated Jul. 3, 2023 for corresponding Japanese Patent Application No. 2020-523384.
Notice of Allowance dated Oct. 26, 2023 for corresponding Korean Patent Application No. 2020-7013054.
Office Action dated Jan. 9, 2024 issued in corresponding Japanese Patent Application No. 2020-523384.
International Search Report and Written Opinion for corresponding International Application No. PCT/EP2018/078805 dated Jan. 22, 2019.
International Preliminary Report on Patentability for corresponding Application No. PCT/EP2018/078805, dated Sep. 18, 2019.
Russian Office Action and Search Report dated Dec. 15, 2021 corresponding to Russian Patent Application No. 2020117038.
Russian Decision to Grant dated May 6, 2022 corresponding to Russian Patent Application No. 2020117038.
Brazillian Office Action dated Jul. 21, 2022 for corresponding Brazilian Patent Application No. 1120200078115.
Japanese Office Action dated Dec. 7, 2022 for corresponding Japanese Patent Application No. 2020-523384.
Chinese Office Action dated Dec. 20, 2022 for corresponding Chinese Patent Application No. 201880068988.1.
Office action dated Jan. 29, 2021 for corresponding U.S. Appl. No. 16/172,195.
Office action dated Jul. 2, 2021 for corresponding U.S. Appl. No. 16/172,195.
Office action dated Dec. 13, 2021 for corresponding U.S. Appl. No. 16/172,195.
Office action dated May 24, 2022 for corresponding U.S. Appl. No. 16/172,195.

* cited by examiner

CARTRIDGE ASSEMBLY FOR AN AEROSOL-GENERATING SYSTEM WITH LEAK PREVENTION

CROSS-REFERENCE TO RELATED APPLICATIONS

The present application is a continuation under 35 U.S.C. § 120 of U.S. application Ser. No. 16/172,195, filed on Oct. 26, 2018, which is a continuation of, and claims priority to international application number PCT/EP2018/078805, filed on Oct. 19, 2018, and further claims priority under 35 USC § 119 to European patent application number 17198704.3, filed on Oct. 26, 2017, the entire contents of each of which are incorporated herein by reference.

FIELD

Example embodiments relate to aerosol-generating systems, such as handheld electrically operated aerosol-generating systems and in particular to cartridges for aerosol-generating systems containing a supply of aerosol-forming substrate and a heater assembly.

DESCRIPTION OF RELATED ART

Handheld electrically operated aerosol-generating systems that consist of a device portion comprising a battery and control electronics, and a cartridge portion comprising a supply of aerosol-forming substrate, also known as a pre-vapor formulation, held in a storage portion and an electrically operated heater assembly acting as a vaporiser are known. A cartridge comprising both a supply of aerosol-forming substrate held in the storage portion and a vaporiser is sometimes referred to as a "cartomizer". The heater assembly may include a fluid-permeable heating element that is in contact with the aerosol-forming substrate held in the storage portion.

SUMMARY

At least one example embodiment relates cartridge assembly for an aerosol-generating system.

In one embodiment, the cartridge assembly includes a housing having a mouth end and an opposed device end configured to connect to an aerosol-generating device, at least one housing air outlet provided at the mouth end of the housing, and at least one housing air inlet provided upstream of the housing air outlet; and a cartridge disposed in the housing, the cartridge including a cartridge body; a fluid-permeable heating element disposed within the cartridge body; at least one cartridge air inlet; at least one cartridge air outlet; and a cartridge airflow path extending from the at least one cartridge air inlet to the at least one cartridge air outlet, via the fluid-permeable heating element; wherein, at least a portion of the cartridge is configured to be movable between a first position, in which air from the housing air inlet is blocked from flowing to the housing air outlet, via the cartridge air inlet, the fluid-permeable heating element, and the cartridge air outlet; and a second position, in which an airflow path exists from the housing air inlet to the housing air outlet, via the cartridge air inlet, the fluid-permeable heating element, and the cartridge air outlet.

In one embodiment, the housing further includes a storage container containing a supply of liquid aerosol-forming substrate, and wherein when the cartridge is inserted into the housing, the fluid-permeable heating element is positioned across an opening in the storage container.

In one embodiment, the cartridge further includes a storage container within the cartridge body, said storage container containing a supply of liquid aerosol-forming substrate, and wherein the fluid-permeable heating element is positioned across an opening in the storage container.

In one embodiment, a biasing member configured to move the cartridge towards the first position.

In one embodiment, the at least a portion of the cartridge is configured to be in the second position when the housing connects to the aerosol-generating device.

In one embodiment, the cartridge assembly further including an insert member disposed between the cartridge and the housing, wherein the insert member includes at least one insert member air inlet and at least one insert member air outlet, and wherein when cartridge is in the first position the insert member air inlet is misaligned with the cartridge air inlet, and the insert member air outlet is misaligned with the cartridge air outlet; and wherein when the cartridge is in the second position, the insert member air inlet is aligned with the cartridge air inlet, and the insert member air outlet is aligned with the cartridge air outlet.

In one embodiment, the cartridge body includes a main body configured to house the fluid-permeable heating element, and wherein the at least one cartridge air inlet includes at least one opening in the main body of the cartridge; the at least one cartridge air outlet includes at least one opening in the main body of the cartridge, or both the at least one cartridge air inlet includes at least one opening in the main body of the cartridge, and the at least one cartridge air outlet includes at least one opening in the main body of the cartridge.

In one embodiment, the cartridge body includes a cartridge cap configured to connect to the cartridge main body, and cover the fluid-permeable heating element.

In one embodiment, the cartridge cap is provided with electrical connectors to form an electrical connection with the fluid-permeable heating element.

In one embodiment, the cartridge cap includes a base configured to connect to the cartridge main body, and a top, which is configured to connect to, and at least partially cover, the cartridge cap base, and wherein the cartridge cap base and cartridge cap top together define at least one cartridge air inlet for air to flow into the cartridge and across the top of the fluid-permeable heating element.

In one embodiment, the cartridge cap further includes a threaded member disposed between the cartridge cap base and cartridge cap top, the threaded member being configured to move between a first position in which the threaded member provides a sealed enclosure for the fluid-permeable heating element; and a second position in which the threaded member is spaced away from the fluid-permeable heating element to define an airflow channel for air to flow between the fluid-permeable heating element and the cartridge air inlet, the cartridge air outlet, or both.

In one embodiment, the cartridge includes a locking system for temporarily affixing the cartridge to the housing.

In one embodiment, the cartridge including a cartridge body; a storage container within the cartridge body, the storage container containing a supply of liquid aerosol-forming substrate; and a fluid-permeable heating element disposed within the cartridge body and positioned across an opening in the storage container; the cartridge body includes at least one cartridge air inlet, and at least one cartridge air outlet, and a cartridge airflow path extending from the at least one cartridge air inlet to the at least one cartridge air outlet, via the fluid-permeable heating element, at least a portion of the cartridge is configured to move within the cartridge body between a first position, in which air from the cartridge air inlet is blocked from flowing to the cartridge air outlet, via the fluid-permeable heating element; and a second position, in which an airflow path exists from the cartridge air inlet to the cartridge air outlet, via the fluid-permeable heating element.

In one embodiment, including a cartridge assembly and an aerosol-generating device comprising a power supply and control electronics, wherein the cartridge assembly is configured to connect to the aerosol-generating device.

In one embodiment, a kit for an aerosol-generating system including a housing having a mouth end and an opposed device end configured to connect to an aerosol-generating device, at least one housing air outlet provided at the mouth end of the housing, and at least one housing air inlet provided upstream of the housing air outlet; and a cartridge configured to be inserted into the housing, the cartridge including a cartridge body; a fluid-permeable heating element disposed within the cartridge body; at least one cartridge air inlet; at least one cartridge air outlet; and a cartridge airflow path extending from the at least one cartridge air inlet to the at least one cartridge air outlet, via the fluid-permeable heating element; and wherein, when the cartridge is inserted into the housing, at least a portion of the cartridge is configured to be movable between a first position, in which air from the housing air inlet is blocked from flowing to the housing air outlet, via the cartridge air inlet, the fluid-permeable heating element, and the cartridge air outlet; and a second position, in which an airflow path exists from the housing air inlet to the housing air outlet, via the cartridge air inlet, the fluid-permeable heating element, and the cartridge air outlet.

In one embodiment, the cartridge body includes a main body configured to house the fluid-permeable heating element, and wherein.

BRIEF DESCRIPTION OF THE DRAWINGS

Features described above in relation to one example embodiment may also be applicable to other example embodiments.

Example embodiments will now be described with reference to the accompanying drawings.

DETAILED DESCRIPTION

Figure 1:
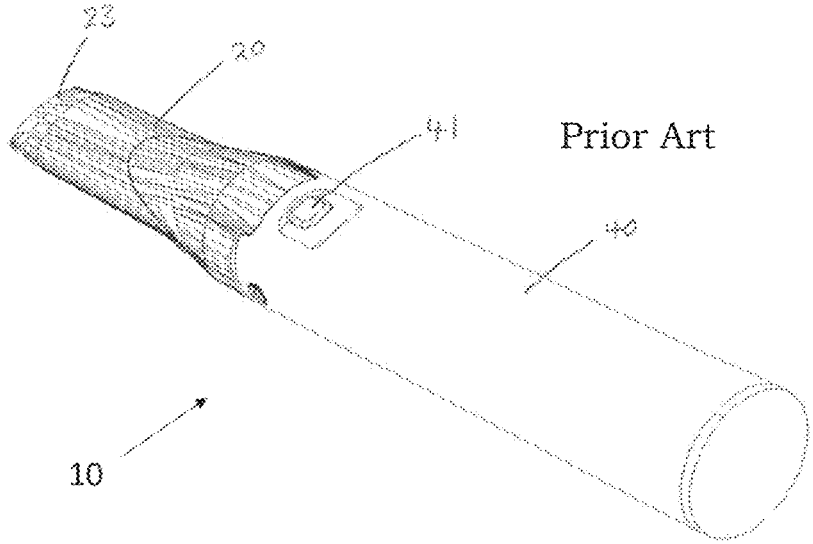
FIG. 1 illustrates a perspective view of an aerosol-generating system having a prior art cartridge assembly and an aerosol-generating device.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, elements, regions, layers and/or sections, these elements, elements, regions, layers, and/or sections should not be limited by these terms. These terms are only used to distinguish one element, element, region, layer, or section from another region, layer, or section. Thus, a first element, element, region, layer, or section discussed below could be termed a second element, element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or elements, but do not preclude the presence or addition of one or more other features, integers, steps, operations, elements, elements, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

General Methodology

It would be desirable to provide a cartridge assembly that is more robust and less likely to leak. It would also be desirable to provide a cartridge assembly having a reusable housing.

Specific Example Embodiments

According to a first aspect of the example embodiments, there is provided a cartridge assembly for an aerosol-generating system. The cartridge assembly including a housing having a mouth end and an opposed device end, with at least one housing air outlet provided at the mouth end of the housing, and at least one housing air inlet provided upstream of the housing air outlet. The cartridge assembly also includes a cartridge disposed within the housing. The cartridge includes a cartridge body; a fluid-permeable heating element disposed within the cartridge body; at least one cartridge air inlet; at least one cartridge air outlet; and a cartridge airflow path extending from the at least one cartridge air inlet to the at least one cartridge air outlet, via the fluid-permeable heating element. At least a portion of the cartridge is configured to be movable between a first position, in which air from the housing air inlet is blocked from flowing to the housing air outlet, via the cartridge air inlet, the fluid-permeable heating element, and the cartridge air outlet; and a second position, in which an unrestricted airflow path exists from the housing air inlet to the housing air outlet, via the cartridge air inlet, the fluid-permeable heating element, and the cartridge air outlet.

By arranging for at least a portion of the cartridge to be movable between the first and second positions, the airflow path across the fluid permeable heating element can be selectively opened and closed. A consumer can therefore select whether to have the airflow path open, for example when they wish to use the assembly in an aerosol-generating system; or whether to have the airflow path closed, for example when they do not wish to use the assembly in an aerosol-generating system. By arranging for the airflow path to be closed, when the assembly is not in use, the likelihood of accidental leakage of fluid from the assembly can be reduced.

The cartridge may be removable from the housing. By arranging for the cartridge to be removable from the housing, it is possible to reuse the housing after disposing of the cartridge. In particular, when a supply of liquid aerosol-forming substrate, also known as a pre-vapor formulation, has been fully consumed, the cartridge may be removed from the housing and discarded. The same housing may then be reused with a new cartridge.

The cartridge assembly of the first aspect of the example embodiments is supplied in a pre-assembled configuration. In this configuration, the cartridge is already disposed within the housing. In this configuration, the cartridge may be temporarily affixed to the housing to prevent accidental removal of the cartridge from the housing.

As an alternative to being supplied in a pre-assembled configuration, the cartridge assembly may be supplied in an unassembled configuration. In this case, the cartridge may be disposed outside of the housing but configured to be inserted into the housing, for example by a consumer. The cartridge may be configured to be inserted into the housing through an opening at the device end of the housing. Therefore, according to a second aspect of the example embodiments, there is provided a kit for an aerosol-generating system, and in particular, a kit for a cartridge assembly for an aerosol-generating system. The kit includes a housing having a mouth end and an opposed device end configured to connect to an aerosol-generating device, wherein at least one housing air outlet is provided at the mouth end of the housing, and at least one housing air inlet is provided upstream of the housing air outlet; and a cartridge configured to be inserted into the housing. The cartridge includes a cartridge body; a fluid-permeable heating element disposed within the cartridge body; at least one cartridge air inlet; at least one cartridge air outlet; and a cartridge airflow path extending from the at least one cartridge air inlet to the at least one cartridge air outlet, via the fluid-permeable heating element. At least a portion of the cartridge is configured to be movable between a first position, in which air from the housing air inlet is blocked from flowing to the housing air outlet, via the cartridge air inlet, the fluid-permeable heating element, and the cartridge air outlet; and a second position, in which an airflow path exists from the housing air inlet to the housing air outlet, via the cartridge air inlet, the fluid-permeable heating element, and the cartridge air outlet.

In an embodiment, a storage container is provided within the housing, said storage container containing a supply of liquid aerosol-forming substrate, and wherein when the cartridge is inserted into the housing, the fluid-permeable heating element is positioned across an opening in the storage container. The storage container and the housing may be fixed to each other by a mechanical fixing, or by welding or adhesive. The storage container and housing may be integrally formed. The housing and the storage container may be formed form a mouldable plastics material, such as polypropylene (PP) or polyethylene terephthalate (PET).

In an embodiment, the cartridge further includes a storage container within the cartridge body, said storage container containing a supply of liquid aerosol-forming substrate, and wherein the fluid-permeable heating element is positioned across an opening in the storage container. The storage container may be formed from one or more distinct pieces, which are disposed within the cartridge body. Alternatively, the storage container may be integrally formed within the cartridge body. In this case, inner surfaces of the cartridge body can define at least a portion of the boundary of the storage container. The cartridge body and the storage container may be formed form a mouldable plastics material, such as polypropylene (PP) or polyethylene terephthalate (PET).

In an embodiment, the cartridge assembly further includes a biasing member configured to urge the cartridge towards the first position, when the cartridge is disposed within the housing. In an embodiment, the biasing member includes a spring, such as a helical spring. The biasing member may be located at the mouth end of the housing. A first end of the biasing member may be fixed to the inner surface of the housing. A second end of the biasing member may engage with a mouth end of the cartridge.

The cartridge assembly may include an insert member. The insert member may be configured to be inserted into the housing. The insert member may be inserted through an opening at the device end of the housing. The insert member may be disposed between the cartridge and the housing, when the cartridge is in the housing. In an embodiment, the insert member is fixed to an inner surface of the housing.

In an embodiment, the insert member has at least one insert member air inlet and at least one insert member air outlet. In an embodiment, the insert member air inlet is in the form of a first gap or hole in the insert member. In another embodiment, the insert member air outlet is in the form of a second gap or hole in the insert member. When the cartridge is in the first position, the first gap in the insert member may be misaligned with the cartridge air inlet.

In an embodiment, when the cartridge is in the first position, the second gap in the insert member is misaligned with the cartridge air outlet. The misalignment may be radial, axial or both. In an embodiment, when the cartridge is in the second position, the first gap in the insert member is aligned with the cartridge air inlet, and the second gap in the insert member is aligned with the cartridge air outlet. Accordingly, when the cartridge is in the second position, air can flow along an airflow path from the insert member air inlet, through the cartridge air inlet, across the fluid permeable heating element, through the cartridge air outlet, and through the insert member air outlet.

In an embodiment, the insert member is configured to connect to the housing and reside in a fixed position relative to the housing, when connected to the housing. In an embodiment, when the insert member is held in said fixed position, air is free to flow from the housing air inlet to the first gap in the insert member. In an embodiment, when the insert member is held in said fixed position, air is free to flow from the housing air outlet to the second gap in the insert member.

The insert member may enable the cartridges in accordance with the example embodiments to connect to a range of different housings, including prior art housings. That is, the insert member may function as an adaptor so that cartridges in accordance with the example embodiments can connect to a range of different housings, including prior art housings.

The housing may include a mouth end portion. The mouth end portion may be configured to be inserted into the mouth. A draw on the mouth end portion draws aerosol generated in the cartridge through the mouth end portion. Alternatively, a separate mouthpiece portion may be provided, which can be attached to the housing. The housing air outlet may be provided in the mouth end portion of the housing.

The housing may provide the external surface of the cartridge assembly, when the cartridge assembly has been assembled. The housing may therefore be referred to as external housing. The housing may be generally tubular. The housing may include a connecting portion at its device end. The connecting portion may include a mechanical interlock structure, such as a snap fitting or a screw fitting, configured to engage a corresponding interlock structure on an aerosol-generating device. The interlock structure may permit at least some rotation of the housing relative to the device, but prevent axial movement of the housing relative to the device.

The cartridge body may include a main body configured to house the fluid-permeable heating element. Where the cartridge further includes a storage container, the storage container may be within the cartridge main body. The cartridge main body may be substantially cylindrical.

In an embodiment, the at least one cartridge air inlet is provided in the form of at least one opening in the main body of the cartridge. In an embodiment, the at least one cartridge air outlet is provided in the form of at least one opening in the main body of the cartridge. In particular, when the cartridge is in the first position, the at least one air outlet in the main body of the cartridge may be aligned with an upstream end of the internal flow path extending within the housing. This may allow air to flow unrestricted from the at least one air outlet in the main body of the cartridge to the housing air outlet, internal flow path extending within the housing.

In an embodiment the cartridge body includes a cartridge cap. The cartridge cap is configured to connect to the cartridge main body to cover the fluid-permeable heating element. In an embodiment, the cartridge cap is provided with electrical connectors to form an electrical connection with the heating element. In an embodiment, the electrical connectors extend to an outer surface of the cartridge cap. In an embodiment, the electrical connectors may be configured to form an electrical connection with a power supply in an aerosol-generating device, when the cartridge assembly is connected to the device. This may be achieved by arranging for the electrical connectors to connect to contact points in a first portion of the device. In another embodiment, this may be achieved by arranging for the electrical connectors of the cartridge cap to connect to an adaptor member, which is in turn, electrically connected to the contact points in the first portion of the aerosol-generating device.

As will be described in more detail below, in some embodiments, the cartridge cap is a single piece which connects to the device end of the cartridge main body. The connection may be formed by a mechanical interlock structure, such as a snap fitting or a screw fitting, configured to engage a corresponding interlock structure on an aerosol-generating device.

In some other embodiments, the cartridge cap includes two or more elements. For example, the cartridge cap may include a base configured to connect to the cartridge main body. The connection may be formed by a mechanical interlock structure. The cartridge cap may also include a top, which is configured to connect to, and at least partially cover, the cartridge cap base. The base and top may together define the cartridge air inlet for air to flow into the cartridge and across the top of the heating element. The air can then continue to flow along a cartridge air channel, which extends along one side of the cartridge. The cartridge air channel may be enclosed within the cartridge main body and, if present, the cartridge mouth end portion. The cartridge air channel may extend along one side of the storage container in the cartridge body. In an embodiment, the cartridge air outlet is disposed at the end of the cartridge air channel. Air can therefore flow through the cartridge from the cartridge air inlet to the cartridge air outlet, via the space above the heating element and via the cartridge air channel.

In an embodiment, the cartridge cap further includes a threaded member disposed between the cartridge cap base and cartridge cap top.

The threaded member is configured to move between a first position and a second position. When the threaded member is in the first position, it provides a sealed enclosure for the heating element. Consequently, when in the first position the threaded member can block air from flowing between the heating element and the cartridge air inlet, the cartridge air outlet, or both. However, when the threaded member is in the second position, air can flow between the heating element and the cartridge air inlet, the cartridge air outlet, or both. The threaded member may therefore be the at least a portion of the cartridge, which is configured to move between the first position and second position.

The threaded member can move between the first and second positions by way of a threaded engagement between an outer surface of the threaded member, and an inner surface of the cartridge cap base, cartridge cap top, or both. In particular, the outer surface of the threaded member may have a first thread, which is engaged with a second thread on the inner surface of the cartridge cap base, cartridge cap top, or both. Rotation of the threaded member relative to the rest of the cartridge can be initiated by rotation of an aerosol-generating device, which is connected to the cartridge assembly. In particular, the threaded member may have a receiving portion, such as a recessed portion, which is configured to receive a portion of the aerosol-generated device, or a portion of an adaptor member which is connectable to the aerosol generated device. The receiving portion of the threaded member can then engage with the device or adaptor member, such that rotation of the device or adaptor causes rotation of the threaded member relative to the rest of the cartridge. The cartridge cap top may comprise an opening for providing access to the receiving portion of the threaded member.

The threaded member may be a substantially cylindrical plug. A recess may be provided in the upper surface of the substantially cylindrical plug to define the receiving portion. The recess may have any suitable screw drive shape, such as a slot, Phillips, Frearson, Robertson, hex, or the like.

Although the cartridge cap base and cartridge cap top are described as two distinct elements, it will be appreciated that they could be integrally formed as a single element with the threaded member disposed therein. The cartridge cap could also be integrally formed with the cartridge main body.

The cartridge body may include a mouth end portion. The mouth end portion may be attached to the mouth end of the cartridge main body. The mouth end portion may be configured to engage with the biasing member, if a biasing member is present. For example, the mouth end portion may be hollow and have an opening at its mouth end, configured to receive at least part of the biasing member, when the cartridge is inserted into the housing.

The mouth end portion may provide a surface, which a device end of the biasing member can engage with when the cartridge is inserted into the housing. The mouth end portion may define at least part of the storage container. The mouth end portion may be substantially pointed. The mouth end portion may be integrally formed with the cartridge main body, or may be a discrete element, which is connected to the cartridge main body.

The cartridge may include a locking system, such as a bayonet locking system, for temporarily affixing the cartridge to the housing. The locking system may restrict axial movement of the cartridge relative to the housing, but permit at least some radial movement of the cartridge relative to the housing. For example, when the cartridge is affixed to the housing by the locking system, the cartridge may be free to rotate by up to 90 degrees, relative to the housing. Such rotation occurs about the longitudinal axis of the housing.

The locking system may include a guide track in the outer surface of the cartridge body, such as, in the outer surface of the mouth end portion of the cartridge body. A protrusion in the housing or insert member can be located in the guide track when the cartridge is first inserted into the housing. A first portion of the guide track defines an axially extending strip along which the protrusion can slide as the cartridge is pushed into the housing. Where the cartridge assembly includes a biasing member, it may be necessary to overcome the force of the biasing member in order to slide the protrusion all the way along the first portion of the guide track.

Once the cartridge has been inserted sufficiently far into the housing, the protrusion reaches an end face of the first portion of the guide track. The end face may prevent further axial movement of the cartridge into the housing. At this point, a second portion of the guide track extends laterally around the cartridge, and therefore permits the cartridge to be rotated relative to the housing. When the protrusion is located in the second portion of the guide track, the cartridge is prevented from moving axially relative to the housing. This enables the cartridge to be temporarily fixed within the housing.

The end of the second portion of the guide track may join with a third portion of the guide track. The third portion of the guide track may define a further an axially extending strip along which the protrusion can slide. The third portion of the guide track may have first and second end faces, which may restrict the extent of axial movement that the cartridge can have relative to the housing, when the protrusion of the housing is in the third portion of the guide track. The first end face of the third portion of the guide track may restrict the extent to which the cartridge can moving further into the housing. The second end face may stop the cartridge from being removed from the housing. The third portion of the guide track may be used to allow the cartridge to move between the first and second positions, relative to the housing.

The cartridge assembly may further include an adaptor member configured to form a mechanical connection between an aerosol-generating device, and the cartridge, the housing or both the cartridge and the housing. The adaptor member may be configured to provide an electrical connection between the fluid-permeable heating element of the cartridge and a power supply of the aerosol-generating device. The adaptor member may include a locking system, such as a bayonet locking system, for affixing the housing to an aerosol generating device. The locking system may prevent axial movement of the housing relative to the device, but permit at least some radial movement of the housing relative to the device. For example, when the housing is affixed to the device by the locking system of the adaptor member, the housing may be free to rotate by up to 90 degrees, relative to the device. Such rotation occurs about the longitudinal axis of the housing.

The locking system may include a guide track in the outer surface of the adaptor member. A protrusion in the housing or insert member can be located in the guide track when the cartridge assembly is first attached to the adaptor member. A first portion of the guide track defines an axially extending strip along which the protrusion can slide as the adaptor and housing are brought together. Once the adaptor and the housing have been brought together, the protrusion reaches an end face of the first portion of the guide track. The end face may prevent further axial movement of the housing towards the adaptor. At this point, a second portion of the guide track extends laterally around the adaptor member, and therefore permits the housing to be rotated relative to the adaptor member. When the protrusion is located in the second portion of the guide track, the housing is prevented from moving axially relative to the adaptor member. The adaptor member may have a first portion which is configured to mechanically engage with the cartridge, and cause the cartridge to rotate with the adaptor member and the device, relative to the housing. The second portion of the guide track may be used to allow the cartridge to move between the first and second positions, relative to the housing The fluid-permeable heating element may be part of a heater assembly in the cartridge. The heater assembly may include electrical contact pads connected to the fluid-permeable heating element.

The heater assembly may include a heater cap, the heater cap comprising a hollow body with first and second heater cap openings, wherein the first heater cap opening is on an opposite end of the hollow body to the second heater cap opening. The fluid-permeable heating element may be substantially flat. The heating element may be mounted on the heater cap such that the heating element extends across the first heater cap opening. The heater cap may be coupled to an open end of the storage container so that the heating element extends across the open end of the storage container.

As used herein, "electrically conductive" means formed from a material having a resistivity of 1×10-4 Ohm meter, or less. As used herein, "electrically insulating" means formed from a material having a resistivity of 1×104 Ohm meter or more. As used herein, "fluid-permeable" in relation to a heater assembly means that the aerosol-forming substrate, in a gaseous phase and possibly in a liquid phase, can readily pass through the heating element of the heater assembly.

The heater assembly may include a substantially flat heating element to allow for simple manufacture. Geometrically, the term "substantially flat" electrically conductive heating element is used to refer to an electrically conductive arrangement of filaments that is in the form of a substantially two dimensional topological manifold. Thus, the substantially flat electrically conductive heating element extends in two dimensions along a surface substantially more than in a third dimension. In particular, the dimensions of the substantially flat heating element in the two dimensions within the surface is at least five times larger than in the third dimension, normal to the surface. An example of a substantially flat heating element is a structure between two substantially imaginary parallel surfaces, wherein the distance between these two imaginary surfaces is substantially smaller than the extension within the surfaces. In some embodiments, the substantially flat heating element is planar. In other embodiments, the substantially flat heating element is curved along one or more dimensions, for example forming a dome shape or bridge shape.

The term "filament" is used throughout the specification to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner The heating element may be an array of filaments, for example arranged parallel to each other. In an embodiment, the filaments may form a mesh. The mesh may be woven or non-woven. The mesh may be formed using different types of weave or lattice structures. Alternatively, the electrically conductive heating element consists of an array of filaments or a fabric of filaments. The mesh, array or fabric of electrically conductive filaments may also be characterized by its ability to retain liquid.

In an example embodiment, a substantially flat heating element may be constructed from a wire that is formed into a wire mesh. In an embodiment, the mesh has a plain weave design. In an embodiment, the heating element is a wire grill made from a mesh strip.

The electrically conductive filaments may define interstices between the filaments and the interstices may have a width of between 10 micrometres and 100 micrometres. The filaments may give rise to capillary action in the interstices, so that in use, liquid to be vaporized is drawn into the interstices, increasing the contact area between the heating element and the liquid aerosol-forming substrate.

The electrically conductive filaments may form a mesh of size between 60 and 240 filaments per centimetre (+/−10 percent). In an embodiment, the mesh density is between 100 and 140 filaments per centimetres (+/−10 percent). In an embodiment, the mesh density is approximately 115 filaments per centimetre. The width of the interstices may be between 100 micrometres and 25 micrometres, such as between 80 micrometres and 70 micrometres, or approximately 74 micrometres. The percentage of open area of the mesh, which is the ratio of the area of the interstices to the total area of the mesh may be between 40 percent and 90 percent, or between 85 percent and 80 percent, or approximately 82 percent.

The electrically conductive filaments may have a diameter of between 8 micrometres and 100 micrometres, between 10 micrometres and 50 micrometres, or between 12 micrometres and 25 micrometres, such as, approximately 16 micrometres. The filaments may have a round cross section or may have a flattened cross-section.

The area of the mesh, array or fabric of electrically conductive filaments may be small, for example less than or equal to 50 square millimetres, less than or equal to 25 square millimetres, or approximately 15 square millimetres. The size may be chosen such to incorporate the heating element into a handheld system. Sizing of the mesh, array or fabric of electrically conductive filaments less or equal than 50 square millimetres may reduce the amount of total power required to heat the mesh, array or fabric of electrically conductive filaments while still ensuring sufficient contact of the mesh, array or fabric of electrically conductive filaments to the liquid aerosol-forming substrate. The mesh, array or fabric of electrically conductive filaments may, for example, be rectangular and have a length between 2 millimetres to 10 millimetres and a width between 2 millimetres and 10 millimetres. In an embodiment, the mesh has dimensions of approximately 5 millimetres by 3 millimetres.

The filaments of the heating element may be formed from any material with suitable electrical properties. Suitable materials include but are not limited to semiconductors such as doped ceramics, electrically "conductive" ceramics (such as, for example, molybdenum disilicide), carbon, graphite, metals, metal alloys and composite materials made of a ceramic material and a metallic material. Such composite materials may include doped or undoped ceramics. Examples of suitable doped ceramics include doped silicon carbides. Examples of suitable metals include titanium, zirconium, tantalum and metals from the platinum group.

Examples of suitable metal alloys include stainless steel, constantan, nickel-, cobalt-, chromium-, aluminum-, titanium-, zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and iron-manganese-aluminum based alloys. Timetal® is a registered trade mark of Titanium Metals Corporation. The filaments may be coated with one or more insulators. Example materials for the electrically conductive filaments may be stainless steel and graphite, for example, 300 series stainless steel like AISI 304, 316, 304L, 316L. Additionally, the electrically conductive heating element may include combinations of the above materials. A combination of materials may be used to improve the control of the resistance of the substantially flat heating element. For example, materials with a high intrinsic resistance may be combined with materials with a low intrinsic resistance. This may allow for additional combinations if one of the materials is more beneficial from other perspectives, for example price, machinability or other physical and chemical parameters. Additionally, a substantially flat filament arrangement with increased resistance reduces parasitic losses. Further, high resistivity heaters allow more efficient use of battery energy.

In an embodiment, the filaments are made of wire. In an embodiment, the wire is made of metal, such as stainless steel.

The electrical resistance of the mesh, array or fabric of electrically conductive filaments of the heating element may be between 0.3 Ohms and 4 Ohms or, is equal or greater than 0.5 Ohms. In another embodiment, the electrical resistance of the mesh, array or fabric of electrically conductive filaments is between 0.6 Ohms and 0.8 Ohms, such as about 0.68 Ohms. The electrical resistance of the mesh, array or fabric of electrically conductive filaments may be at least an order of magnitude, or at least two orders of magnitude, greater than the electrical resistance of electrically conductive contact areas. This may allow the heat generated by passing current through the heating element to be localized to the mesh or array of electrically conductive filaments. A low resistance, high current system allows for the delivery of high power to the heating element. This allows the heating element to heat the electrically conductive filaments to a desired temperature quickly.

When the cartridge assembly includes a storage container, the storage container may hold a liquid retention material for holding a liquid aerosol-forming substrate. The liquid retention material may be a foam, and sponge of collection of fibres. The liquid retention material may be formed from a polymer or co-polymer. In one embodiment, the liquid retention material is a spun polymer.

In an embodiment, the storage container holds a capillary material for transporting liquid aerosol-forming substrate to the heating element. The capillary material may be provided in contact with the heating element. In an embodiment, the capillary material is arranged between the heating element and the retention material.

The capillary material may be made of a material capable of substantially guaranteeing that there is liquid aerosol-forming substrate in contact with at least a portion of the surface of the heating element. The capillary material may extend into interstices between the filaments. The heating element may draw liquid aerosol-forming substrate into the interstices by capillary action.

A capillary material is a material that actively conveys liquid from one end of the material to another. The capillary material may have a fibrous or spongy structure. The capillary material may include a bundle of capillaries. For example, the capillary material may include a plurality of fibres or threads or other fine bore tubes. The fibres or threads may be generally aligned to convey liquid aerosol-forming substrate towards the heating element. Alternatively, the capillary material may include sponge-like or foam-like material. The structure of the capillary material may form a plurality of small bores or tubes, through which the liquid aerosol-forming substrate can be transported by capillary action. The capillary material may include any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid aerosol-forming substrate has physical properties, including but not limited to viscosity, surface tension, density, thermal conductivity, boiling point and vapor pressure, which allow the liquid aerosol-forming substrate to be transported through the capillary medium by capillary action.

The aerosol-forming substrate may be a substrate capable of releasing volatile compounds that can form an aerosol. The volatile compounds may be released by heating the aerosol-forming substrate.

The aerosol-forming substrate may include plant-based material. The aerosol-forming substrate may include tobacco. The aerosol-forming substrate may include a tobacco-containing material containing volatile tobacco flavor compounds, which are released from the aerosol-forming substrate upon heating. The aerosol-forming substrate may alternatively include a non-tobacco-containing material. The aerosol-forming substrate may include homogenized plant-based material. The aerosol-forming substrate may include homogenized tobacco material. The aerosol-forming substrate may include at least one aerosol-former. The aerosol-forming substrate may include other additives and ingredients, such as flavorants.

The heating element may have at least two electrically conductive contact pads. The electrically conductive contact pads may be positioned at an edge area of the heating element. In an embodiment, the at least two electrically conductive contact pads may be positioned on extremities of the heating element. An electrically conductive contact pad may be fixed directly to the electrically conductive filaments. An electrically conductive contact pad may include a tin patch. In another embodiment, an electrically conductive contact pad may be integral with the electrically conductive filaments.

The cartridge may be a disposable article to be replaced with a new cartridge once the liquid storage portion of the cartridge is empty or the amount of liquid in the cartridge is below a minimum volume threshold. When the cartridge includes a storage container, the cartridge may be pre-loaded with liquid aerosol-forming substrate.

In some example embodiments, the entire cartridge is configured to be movable between the first and second positions of the first example embodiment, relative to the housing.

In some other example embodiments, such as embodiments involving a threaded member, only a part of the cartridge is configured to move between the first and second positions of the first example embodiment, relative to the housing. In these embodiments, the rest of the cartridge may remain stationary relative to the housing.

Therefore, according to a third example embodiment, there is provided a cartridge for an aerosol-generating system, the cartridge including a cartridge body, a storage container within the cartridge body, the storage container containing a supply of liquid aerosol-forming substrate; and a fluid-permeable heating element disposed within the cartridge body and positioned across an opening in the storage container. The cartridge body includes at least one cartridge air inlet, and at least one cartridge air outlet, and a cartridge airflow path extending from the at least one cartridge air inlet to the at least one cartridge air outlet, via the fluid-permeable heating element. At least a portion of the cartridge is configured to move within the cartridge body between a first position, in which air from the cartridge air inlet is blocked from flowing to the cartridge air outlet, via the fluid-permeable heating element; and a second position, in which an unrestricted airflow path exists from the cartridge air inlet to the cartridge air outlet, via the fluid-permeable heating element.

The cartridge of the third example embodiment may have any of the features described about in respect of the first and second example embodiments, such as the features relating to the threaded member and cartridge cap. The at least a portion of the cartridge may be a single element, such as the threaded member.

According to a fourth example embodiment, there is provided an aerosol-generating system comprising a cartridge assembly in accordance with the first or second example embodiments and an aerosol-generating device comprising a power supply and control electronics, wherein the cartridge assembly is configured to connect to the aerosol-generating device. When the cartridge assembly is connected to the aerosol-generating device, the fluid-permeable heater element may be electrically connected to the power supply.

The aerosol-generating device may include a connecting portion for engagement with a corresponding connecting portion on the cartridge assembly.

The aerosol-generating device may include at least one electrical contact element configured to provide an electrical connection to the heating element when the aerosol-generating device is connected to the cartridge assembly. The electrical contact element may be elongate. The electrical contact element may be spring-loaded. The electrical contact element may contact an electrical contact pad in the cartridge assembly.

The power supply may be a battery, such as a lithium ion battery. As an alternative, the power supply may be another form of charge storage device such as a capacitor. The power supply may require recharging. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the heater assembly.

The control electronics may include a microcontroller. The microcontroller is may be a programmable microcontroller. The electric circuitry may include further electronic components. The electric circuitry may be configured to regulate a supply of power to the heater assembly. Power may be supplied to the heater assembly continuously following activation of the system or may be supplied intermittently, such as on a puff-by-puff basis. The power may be supplied to the heater assembly in the form of pulses of electrical current.

The aerosol-generating system may be a handheld system. The aerosol-generating system may be portable. The aerosol-generating system may have a size comparable to a conventional cigar or cigarette. The aerosol-generating device system may have a total length between approximately 30 millimetres and approximately 150 millimetres. The aerosol-generating device system may have an external diameter between approximately 5 millimetres and approximately 30 millimetres.

FIG. 1 illustrates a perspective view of an aerosol-generating system having a prior art cartridge assembly and an aerosol-generating device. As shown, an aerosol-generating system 10 comprising a prior art cartridge assembly 20, and an aerosol-generating device 40 that are coupled together.

Figure 2:
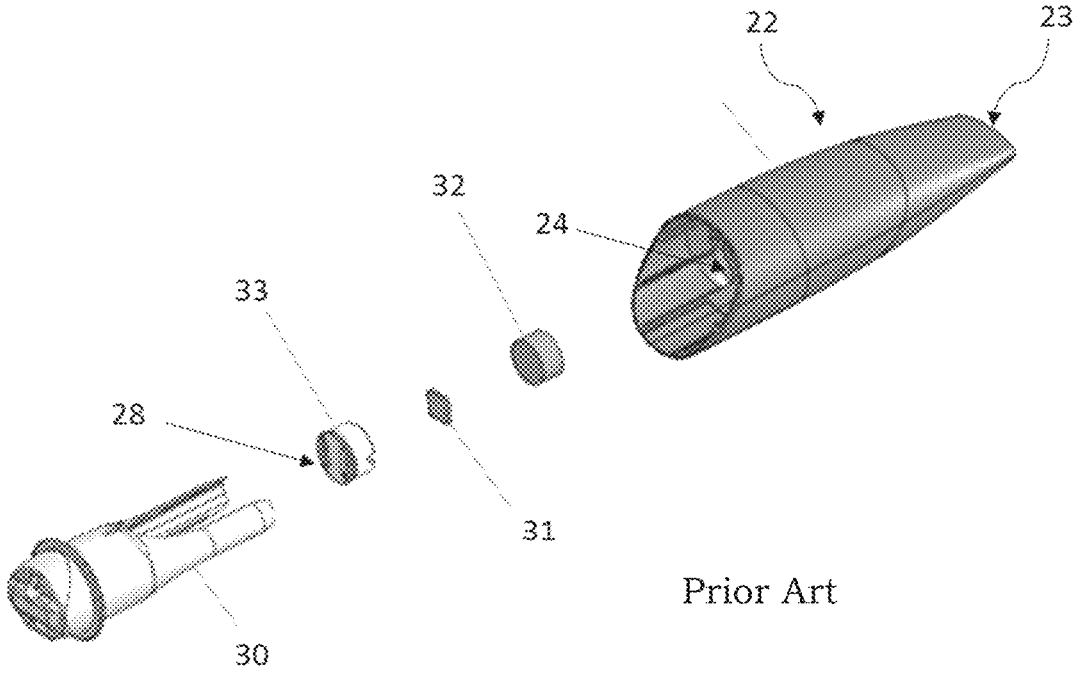
FIG. 2 illustrates an exploded perspective view of the prior art cartridge assembly of FIG. 1.

FIG. 2 illustrates an exploded perspective view of the prior art cartridge assembly of FIG. 1. As shown, the cartridge assembly 20 includes a housing 22, which forms a mouthpiece for the system. Within the housing there is a storage container 24 holding liquid aerosol-forming substrate 26. The storage container 24 is open at the device end. A heater assembly comprising a flat liquid permeable mesh heating element 28 held onto a heater cap 33, is arranged to cover the open device end of the storage container 24. A liquid retention 32 material is positioned within the cap. A capillary material 31 is positioned between the heater assembly and the retention material 32. A protective cover or cap 30 is fitted to the housing to retain the heater assembly in a fixed position relative to the storage container 24. The protective cover also covers the heating element 28 and protects it from damage.

Figure 3:
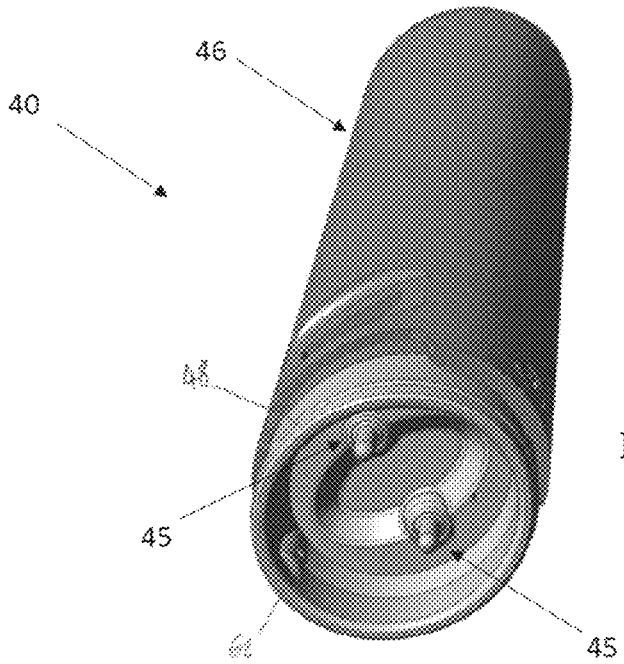
FIG. 3 illustrates a perspective view of the prior art device of FIG. 1.

FIG. 3 illustrates a perspective view of the prior art aerosol-generating device of FIG. 2. The device 40 includes a housing 46, holding a power supply, in the form of a lithium ion battery 42 and control circuitry 44. The device also includes spring loaded electrical contact elements 45, configured to contact electrical contact pads on the heater assembly in the cartridge. The contact elements 45 are electrically coupled to the power supply, so that when the cartridge assembly 20 is connected to the device 40, electrical power can be supplied to the mesh heating element 28 in the cartridge assembly 20.

A button 41 is provided, that actuates a switch in the control circuitry to activate the device. When the device is activated, the control circuitry supplies power from the battery to the heater in the cartridge. The control circuitry may be configured to control the supply of power to the heater after activation in many different ways, as is known in the art. For example, the control circuitry may be configured to control the power supplied to the heater based on one or more of a temperature of the heater, a detected airflow through the system, a time following activation, a determined or estimated liquid amount in the cartridge, an identity of the cartridge and ambient conditions.

The cartridge 20 and device 40 are arranged to couple to one another by a push fitting. The cartridge housing 22 is shaped to allow it to couple to the device 40 in only two orientations, ensuring that spring loaded electrical contact elements 45 can contact the contact pads of the heater assembly via openings in the protective cover 30. A connecting rib 48 of the device portion engages a recess 25 on the housing 22 to retain the cartridge and device portion together.

Figure 4:
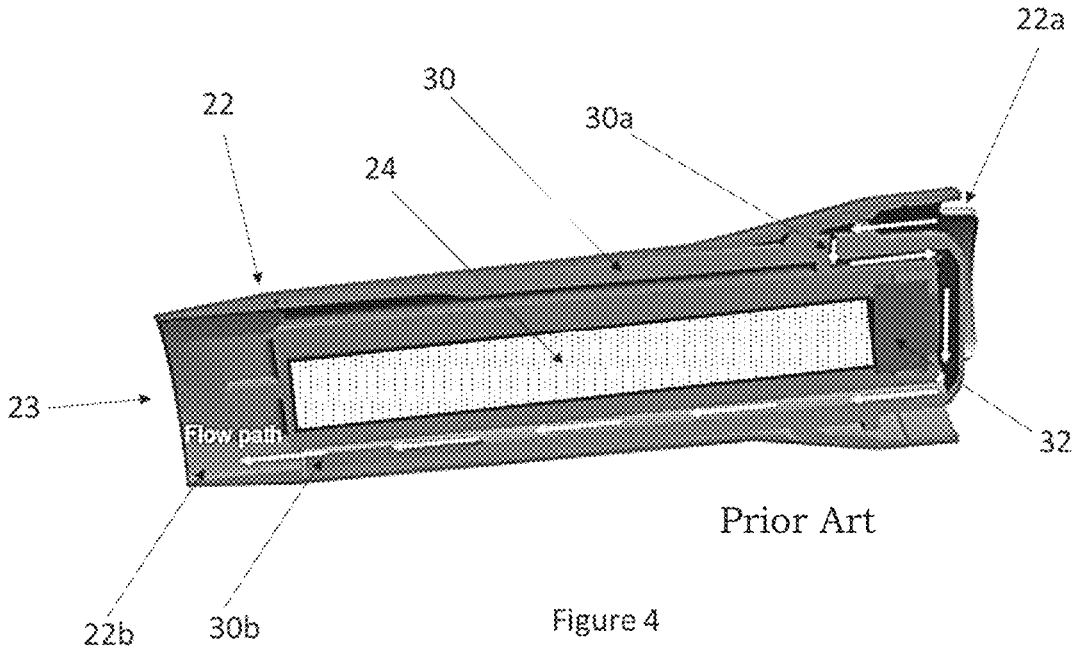
FIG. 4 illustrates a sectional view of the prior art cartridge assembly of FIG. 1.

FIG. 4 illustrates a sectional view of the prior art cartridge assembly of FIG. 1. As shown, the prior art cartridge assembly 20 includes a supply of liquid aerosol-forming substrate 24 and heater assembly. The device functions to supply electrical power to the heater assembly in the prior art cartridge assembly 20 in order to vaporise the liquid aerosol-forming substrate. The vaporised aerosol-forming substrate is entrained in an airflow through the system, the airflow resulting from puffing on a mouthpiece 23 of the prior art cartridge assembly 20. The vaporised aerosol-forming substrate cools in the airflow to form an aerosol before being through the mouthpiece 23.

The airflow path in FIG. 4 is illustrated by arrows. In particular, when air is drawn through the mouth end 23 of the housing 22, air is drawn into the cartridge assembly at an upstream housing air inlet 22*a*. The air then passes through an air inlet 30*a* in the protective cap 30, and past the liquid permeable heating element 28. The vaporised aerosol-forming substrate is then drawn by the air along the flow path and through an air outlet 30*b* in the protective cap 30, before finally exiting the assembly 20 at a housing air outlet 22*b* at the mouth end 23 of the housing 22. In this prior art arrangement there is a possibility of liquid leaking out of the cartridge assembly 20 through one or both of housing air inlet 22*a* and housing air outlet 22*b*.

Figure 5:
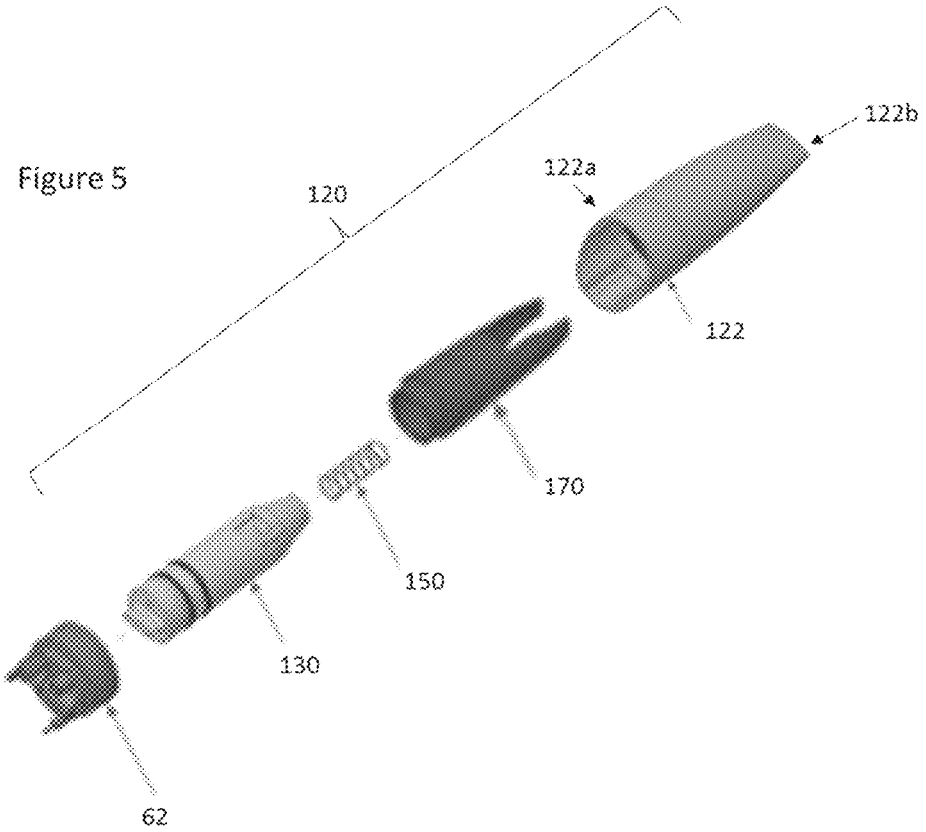
FIG. 5 illustrates an exploded perspective view of a cartridge assembly, and a first portion of an aerosol-generating device, in accordance with an example embodiment.

FIG. 5 illustrates an exploded perspective view of a cartridge assembly, and a first portion of an aerosol-generating device, in accordance with an example embodiment. As shown, an exploded perspective view of a cartridge assembly 120 according to a first example embodiment, and a first portion 62 of an aerosol-generating device. The cartridge assembly 120 includes a cartridge 130, a helical spring 150, an insert member 170, and a housing 122 in the form of a mouthpiece. It will be appreciated that a single housing item could be provided instead of both the insert member 170, and the housing 122. The housing includes a housing air inlet 122*a* and a housing air outlet 122*b*.

The cartridge assembly 120 may be supplied in an assembled configuration, in which case the insert member 170 and the spring 150 are pre-fixed to the inside of the housing 122. The cartridge 130 can be removable from the housing 122. When the cartridge 120 is disposed within the housing 122, the cartridge 120 is positioned within the insert member 170.

Figure 6:
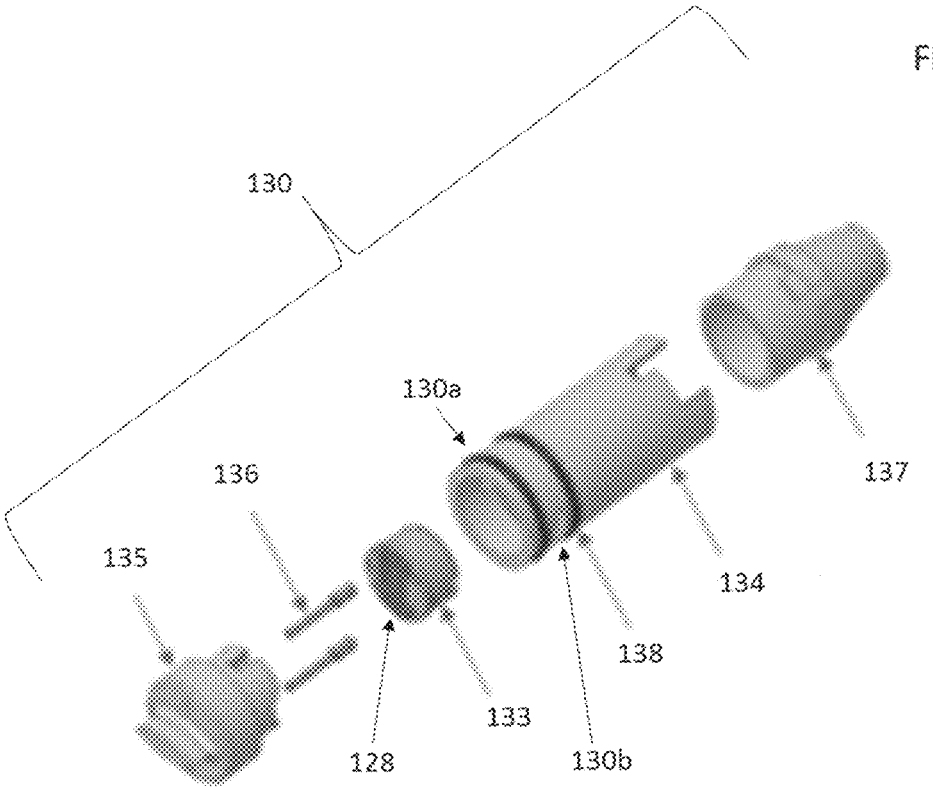
FIG. 6 illustrates an exploded perspective view of the cartridge of FIG. 5, in accordance with an example embodiment.

FIG. 6 illustrates an exploded perspective view of the cartridge of FIG. 5, in accordance with an example embodiment. As shown, the cartridge includes a heating assembly comprising a flat liquid permeable mesh heating element 128 held onto a heater cap 133. The heating assembly is arranged to fit within a device end of a main body 134 of the cartridge 130, and be in fluid communication with a storage container within the main body 134 of the cartridge, which holds liquid aerosol-forming substrate. The main body of the cartridge 130 includes an aperture which forms a cartridge air inlet 130*a* and an aperture which forms a cartridge air outlet 130*b*. The apertures are positioned above the heater assembly when the heater assembly is placed within the cartridge main body. This enables air to flow from the inlet 130*a* to the outlet 130*b* across the top of the heating element 128. This enables vaporised aerosol-forming substrate to be entrained in the airflow as it passes through the cartridge 130.

The cartridge 130 also includes a cartridge cap 133, which is configured to connect to the cartridge main body 134, and cover the fluid-permeable heating element 128. The cartridge cap is provided with electrical connectors 136 to form an electrical connection with the heating element 128. The electrical connectors 136 extend to an outer surface of the cartridge cap 135. This allows the electrical connectors to form an electrical connection with a power supply in an aerosol-generating device 40, when the cartridge assembly 120 is connected to the device 40.

The cartridge 130 also includes a mouth end portion 137, which is formed as a hollow tip. The end of the hollow tip 137 is open and configured to receive at least part of the helical spring 150, when the cartridge is inserted into the housing 122. The hollow tip 137 provides a surface, which a device end of the spring 150 can engage with when the cartridge is inserted into the housing 122. This can be best seen from FIGS. 7A and 7B.

Figure 7A:
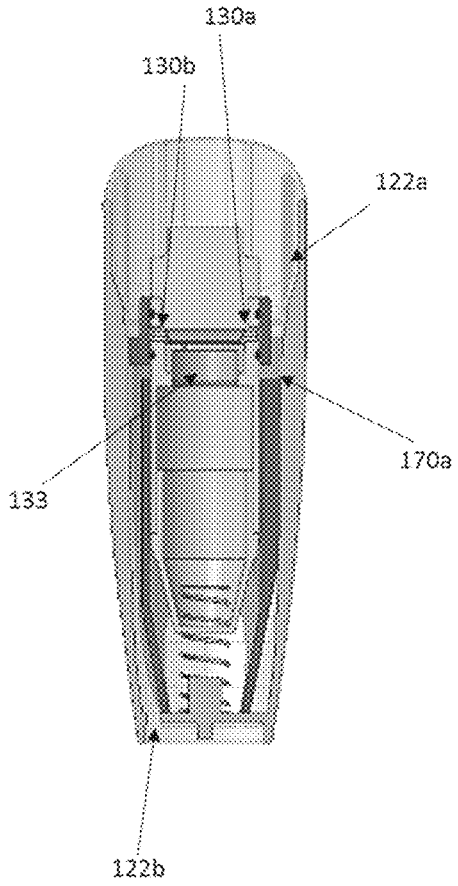
FIG. 7A illustrates a sectional view of the cartridge assembly of FIG. 5, in accordance with an example embodiment.

FIG. 7A illustrates a sectional view of the cartridge assembly of FIG. 5, in accordance with an example embodiment. As shown, when the cartridge 130 is inserted into the housing 122 through its device end, the cartridge 130 resides at a first position within the housing 122. In this position the surface within the hollow tip 137 of the cartridge 130 has engaged with the device end of the spring 150. The biasing action of the spring 150 restricts the cartridge 130 from moving further into the housing 122.

In the position shown in FIG. 7A, air from the housing air inlet 122*a* can pass into the housing and through a first gap 170*a* in the insert member 170. However, the air is then blocked from flowing into the cartridge 130 because the cartridge air inlet 130*a* is not aligned with the first gap 170*a* in the insert member 170. In the first embodiment, this is because the cartridge air inlet 130*a* is located at a different axial position within the housing 122, when compared to the axial position of the first gap 170*a* of the insert member 170. The same is true for the cartridge air outlet 130*b* and the second gap 170*b* of the insert member 170.

The rubber O-rings 138 on the outer surface of the cartridge body also engage with the inner surface of the insert member 170 to provide a seal around the cartridge air inlet 130*a* and cartridge air outlet 130*b*.

Therefore, in the configuration of FIG. 7A, air is blocked from flowing from the housing air inlet 122*a* to the housing air outlet 122*b*, via the cartridge air inlet 130*a*, the fluid-permeable heating element 128, and the cartridge air outlet 130*b*.

Figure 7B:
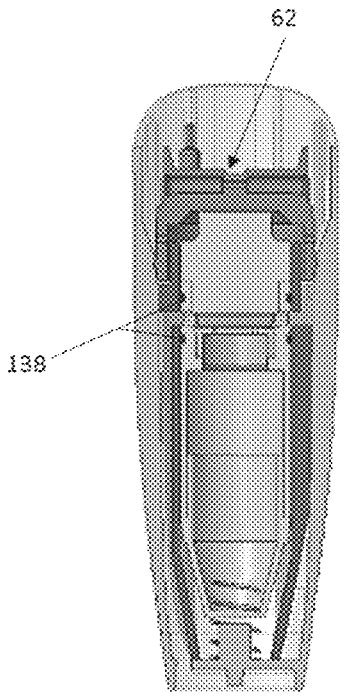
FIG. 7B illustrates a sectional view of the cartridge assembly of FIG. 5, in accordance with an example embodiment.

FIG. 7B illustrates a sectional view of the cartridge assembly of FIG. 5, in accordance with an example embodiment. As shown, when the cartridge assembly 120 is connected to an aerosol generating device 40, a first portion 62 of the device 40 engages with the cartridge cap 135, and overcomes the biasing force of the helical spring 150 to push the cartridge 130 further into the housing 122. When the device 40 is fully connected to the cartridge assembly 120, the cartridge 130 resides within the housing 122 at the position shown in FIG. 7B.

In this position, the cartridge air inlet 130*a* is axially aligned with the first gap 170*a* in the insert member 170, and the cartridge air outlet 130*b* is axially aligned with the second gap 170*b* in the insert member 170. Consequently, air is free to flow from the housing air inlet 122*a* to the housing air outlet 122*b*, via the cartridge air inlet 130*a*, the fluid-permeable heating element 128, and the cartridge air outlet 130*b*.

Figure 8:
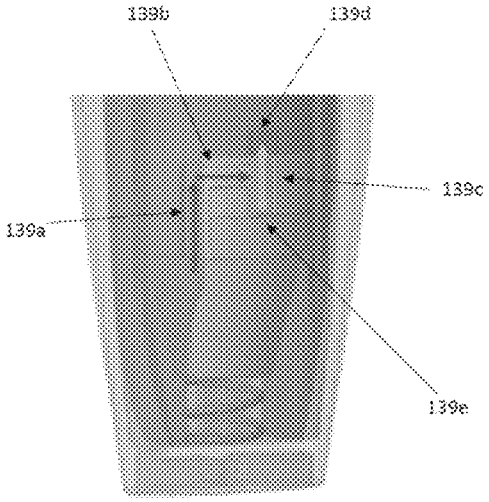
FIG. 8 illustrates an enlarged view of a portion of the cartridge assembly of FIG. 5, in accordance with an example embodiment.

FIG. 8 illustrates an enlarged view of a portion of the cartridge assembly of FIG. 5, in accordance with an example embodiment. As shown, the cartridge body may further include a guide mechanism 139 which is configured to temporarily retain the cartridge within the housing 122, and further configured to restrict the extent of axial movement that the cartridge 130 can have within the housing 122.

In particular, the outer surface of the cartridge body may include a guide track 139, in which a protrusion in the housing 122 or insert member 170 can be located when the cartridge is first inserted into the housing 122. In particular, the guide track 139 defines a bayonet locking mechanism to ensure that the cartridge 130 can be retained in the housing 122 after insertion. The locking mechanism includes a first portion 139*a* of the guide track, which the protrusion can be located in, when the cartridge is first placed into the housing 122.

Once located in this first portion 139*a* of the guide track, the protrusion can slide axially along said first portion 139*a*, as the cartridge 130 moves into the housing 122. The protrusion then reaches an end face of the first portion 139*a* of the guide track, which prevents further axial movement of the cartridge 130 into the housing 122.

However, at this point, a second portion of the guide track 139 extends laterally around the cartridge 130, and therefore permits the cartridge 130 to be rotated relative to the housing 122. As the cartridge 130 is rotated relative to the housing 122, the protrusion moves laterally along the second portion 139*b* of the guide track until it reaches a third portion 139*c* of the guide track.

The third portion 139*c* of the guide track is an axially extending strip having first and second end faces 139*d*, 139*e*, which restrict the extent of axial movement that the cartridge 130 can have within the housing 122. The first end face 139*d* of the third portion 139*c* of the track 139 restricts the extent to which the cartridge 130 can moving further into the housing 122, by engaging with the protrusion of the housing or insert member. The second end face 139*e* stops the cartridge 130 from being removed from the housing 122, by engaging with the protrusion of the housing or insert member.

In order to remove the cartridge 130 from the housing 122, the housing must be moved relative to the cartridge, such that the protrusion retraces its path along the second portion of the track, and then along the first portion of the track 139. The arrows in FIG. 8 indicate the path that the protrusion can follow when moving in the guide track 139.

Figure 9:
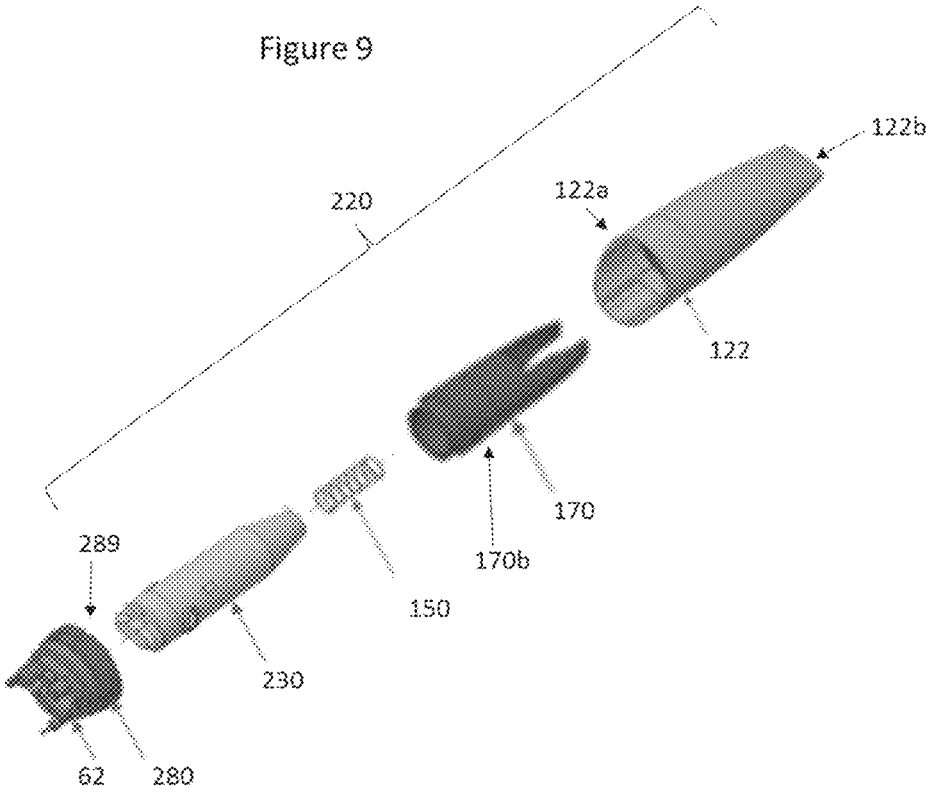
FIG. 9 illustrates an exploded perspective view of a cartridge assembly, a first portion of an aerosol-generating device and an adaptor member, in accordance with an example embodiment.

FIG. 9 illustrates an exploded perspective view of a cartridge assembly, a first portion of an aerosol-generating device and an adaptor member, in accordance with an example embodiment. As shown, the cartridge assembly 220 according to a second example embodiment, together with a first portion of an aerosol-generating device 62 and an adaptor member 280.

The cartridge assembly 220 includes a cartridge 230, a helical spring 150, an insert member 170, and a housing 122 in the form of a mouthpiece. It will be appreciated that a single housing item could be provided instead of both the insert member 170, and the housing 122. The housing includes a housing air inlet 122*a* and a housing air outlet 122*b*. The helical spring 150, insert member 170, and housing 122 can be the same as those described above in respect of the first embodiment.

Figure 10:
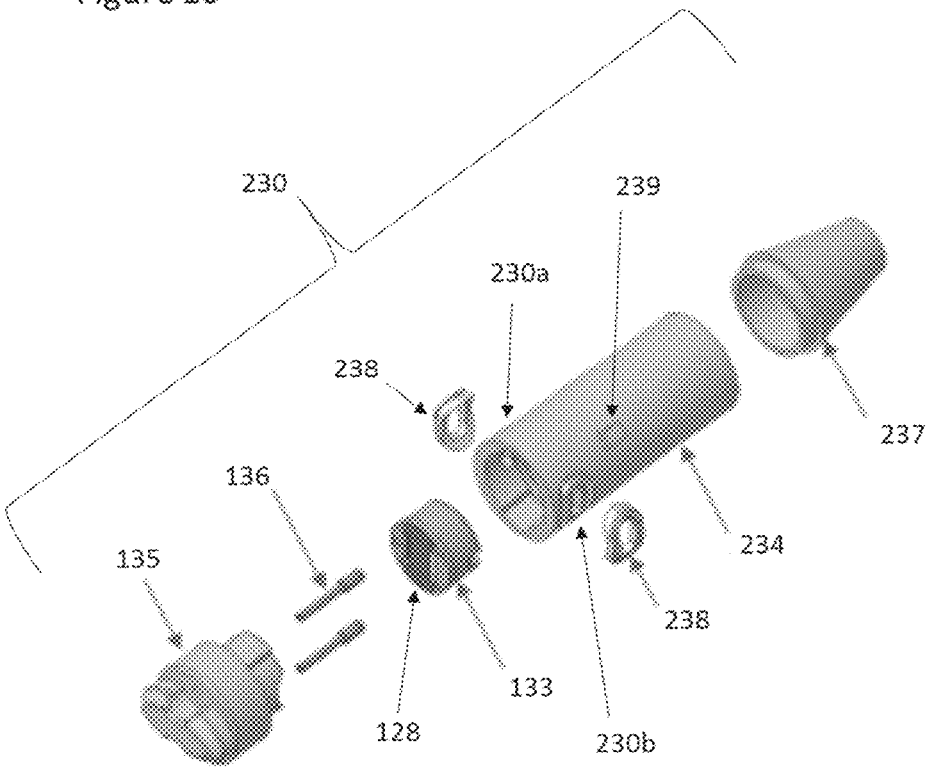
FIG. 10 illustrates an exploded perspective view of the cartridge of FIG. 9, in accordance with an example embodiment.

FIG. 10 illustrates an exploded perspective view of the cartridge of FIG. 9, in accordance with an example embodiment. As shown, similar to the cartridge 130 of FIG. 6, the cartridge 230 of FIG. 10 includes a heating assembly comprising a flat liquid permeable mesh heating element 128 held onto a heater cap 133. The heating assembly is arranged to fit within a device end of a main body 234 of the cartridge 230, and be in fluid communication with a storage container within the main body 234 of the cartridge, which holds liquid aerosol-forming substrate. The main body of the cartridge 230 includes an aperture which forms a cartridge air inlet 230*a* and an aperture which forms a cartridge air outlet 230*b*. The apertures are positioned above the heater assembly when the heater assembly is placed within the cartridge main body. This enables air to flow from the inlet 230*a* to the outlet 230*b* across the top of the heating element 128. This enables vaporised aerosol-forming substrate to be entrained in the airflow as it passes through the cartridge 230.

The cartridge 230 also includes a cartridge cap 135, which is configured to connect to the cartridge main body 234, and cover the fluid-permeable heating element 128. The cartridge cap is provided with electrical connectors 136 to form an electrical connection with the heating element 128. The electrical connectors 136 extend to an outer surface of the cartridge cap 135. This allows the electrical connectors to form an electrical connection with a power supply in an aerosol-generating device 40, when the cartridge assembly 120 is connected to the device 40.

The cartridge 130 also includes a mouth end portion 237, which is formed as a hollow tip. The end of the hollow tip 237 is open and configured to receive at least part of the helical spring 150, when the cartridge is inserted into the housing 122. The hollow tip 237 provides a surface, which a device end of the spring 150 can engage with when the cartridge is inserted into the housing 122. This may be seen from FIGS. 11A and 11B.

Unlike the cartridge of the first embodiment, the cartridge of the second embodiment does not include a guide track 139, which defines a bayonet locking mechanism. Instead, the outer surface of the adaptor member 280 is provided with a bayonet locking mechanism, in the form of a guide track in its outer surface. The adaptor member 280 is connected to the first portion 62 of the device, and held in a rotationally fixed position relative to the device 40.

Figure 11C:
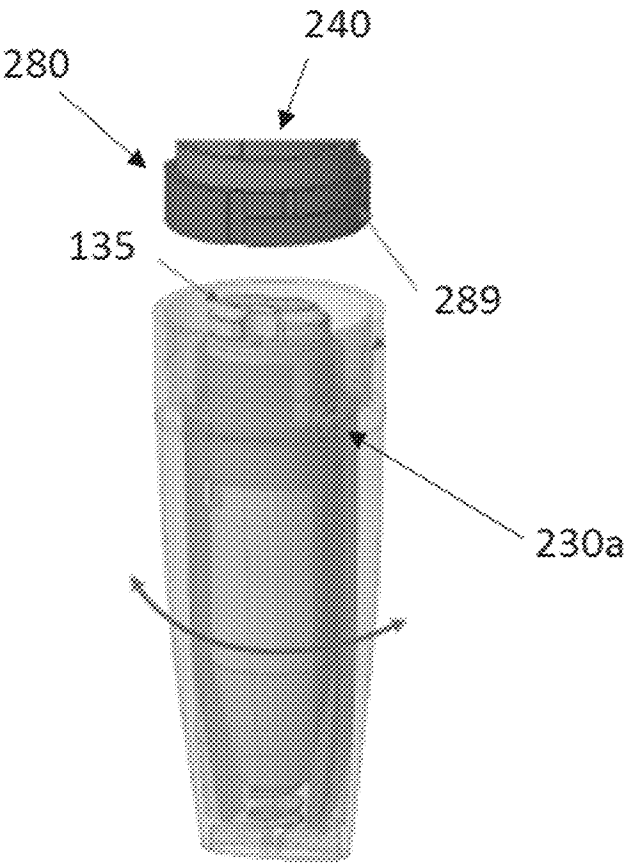
FIG. 11C illustrates a sectional view of the cartridge assembly of FIG. 9, in accordance with an example embodiment.
Figure 11B:
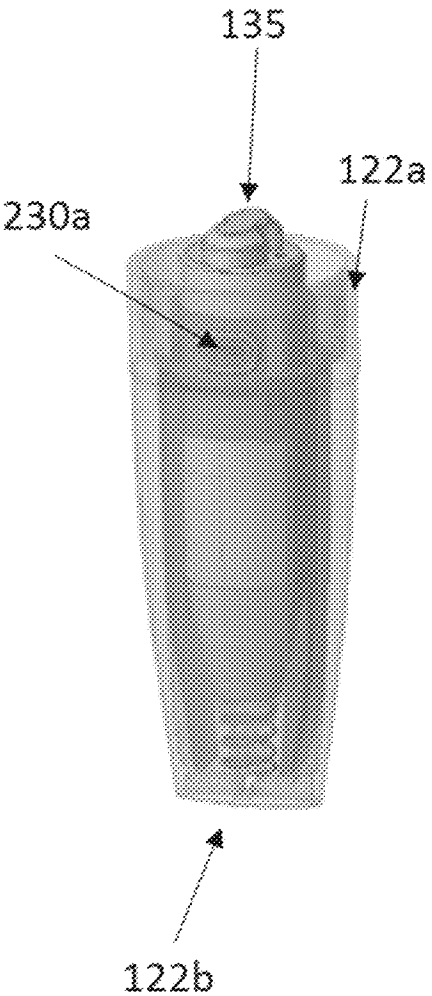
FIG. 11B illustrates a sectional view of the cartridge assembly of FIG. 9, in accordance with an example embodiment.
Figure 11A:
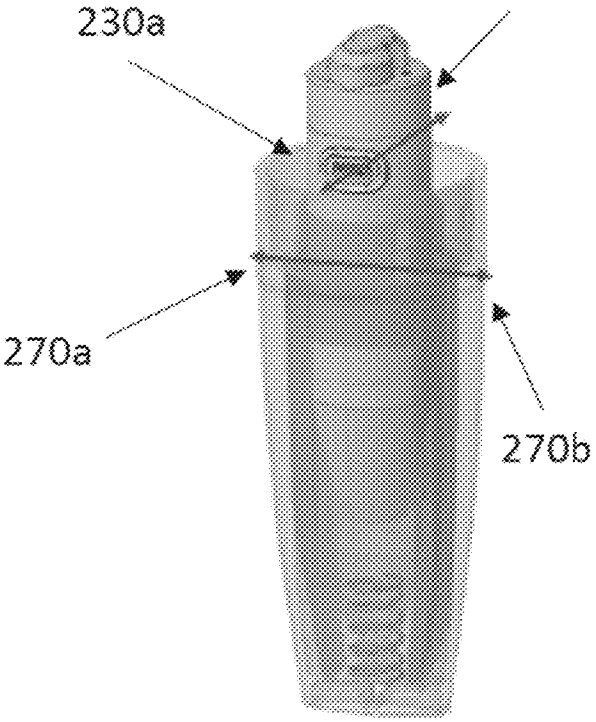
FIG. 11A illustrates a sectional view of the cartridge assembly of FIG. 9, in accordance with an example embodiment.

FIG. 11A illustrates a sectional view of the cartridge assembly of FIG. 9, in accordance with an example embodiment. As shown, before the device 40 and adaptor member 280 is first attached to the cartridge assembly 230, the cartridge assembly has an initial configuration. In this configuration, the cartridge 230 rests on spring 150, and part of the cartridge 230 is disposed within the housing 122. The cartridge cap 135, air inlet 230*a*, and air outlet 230*b* are positioned outside of the housing 122. Due to the presence of a guide protrusion 239 on the outer surface of the cartridge main body 234, the initial orientation of the cartridge 230 is such that the airflow passage between the cartridge air inlet 230*a* and cartridge air outlet 230*b* is radially misaligned from the first gap 170*a* and second gap 170*b*.

When the device 40 and adaptor member 280 are first attached to the cartridge assembly 230, a protrusion in the housing 122 is configured to slide into a first portion of the guide track 289 in the adaptor member 280.

FIG. 11B illustrates a sectional view of the cartridge assembly of FIG. 9, in accordance with an example embodiment. As shown, the first portion of the guide track 289 is an axially extending strip, and therefore as the device and cartridge assembly is brought together, the protrusion slides along the first portion of the guide track 289 until it reaches a first end face of the track 289. At this point, the cartridge 230 and housing 122 have the configuration shown in FIG. 11B. In this configuration, the cartridge is positioned relative to the housing such that air from the housing air inlet 122*a* can pass into the housing 122 and through a first gap 170*a* in the insert member 170. However, the air is then blocked from flowing into the cartridge 230 because the cartridge air inlet 230*a* is not radially aligned with the first gap 170*a* in the insert member 170. This is because the cartridge air inlet 230*a* is located at a different radial position within the housing 122, when compared to the radial position of the first gap 170*a* of the insert member 170. The same is true for the cartridge air outlet 230*b* and the second gap 170*b* of the insert member 170.

The rubber seals 238 which surround the apertures for the cartridge air inlet 230*a* and cartridge air outlet 230*a* also engage with the inner surface of the insert member 170 to provide a seal around the cartridge air inlet 130*a* and cartridge air outlet 130*b*.

Therefore, in the configuration of FIG. 11B, air is blocked from flowing from the housing air inlet 122*a* to the housing air outlet 122*b*, via the cartridge air inlet 130*a*, the fluid-permeable heating element 128, and the cartridge air outlet 130*b*.

However, when the aerosol generating device 40 and adaptor member 280 are rotated relative to the housing 122, the adaptor member 280 mechanically engages with the cartridge cap 135 and causes the cartridge 230 to also rotate relative to the housing 122. During this rotation, the protrusion in the housing 122 is able to slide along a second portion of the guide track 289 in the adaptor member 280.

FIG. 11C illustrates a sectional view of the cartridge assembly of FIG. 9, in accordance with an example embodiment. As shown, after an approximate 90 degree rotation, the cartridge 230 and housing 122 may have the configuration shown in FIG. 11C. In this position, the cartridge air inlet 230*a* is now radially aligned with the first gap 170*a* in the insert member 170, and the cartridge air outlet 230*b* is now radially aligned with the second gap 170*b* in the insert member 170. Consequently, air is free to flow from the housing air inlet 122*a* to the housing air outlet 122*b*, via the cartridge air inlet 230*a*, the fluid-permeable heating element 128, and the cartridge air outlet 230*b*.

In order to remove the cartridge 230 from the housing 122, the housing must be first rotated relative to the device 40 and cartridge 230, such that the protrusion in the housing 122 retraces its path along the second portion of the track in the adaptor member 280. After this, the housing 122 and the device 40 are moved axially away from one another, such that the protrusion in the housing 122 retraces its path along the first portion of the track in the adaptor member 280. When the device 40 has been disconnected from the cartridge assembly 220, the spring 150 is able to push the cartridge 230 away from the housing 122 to the raised position shown in FIG. 11A.

Figure 12:
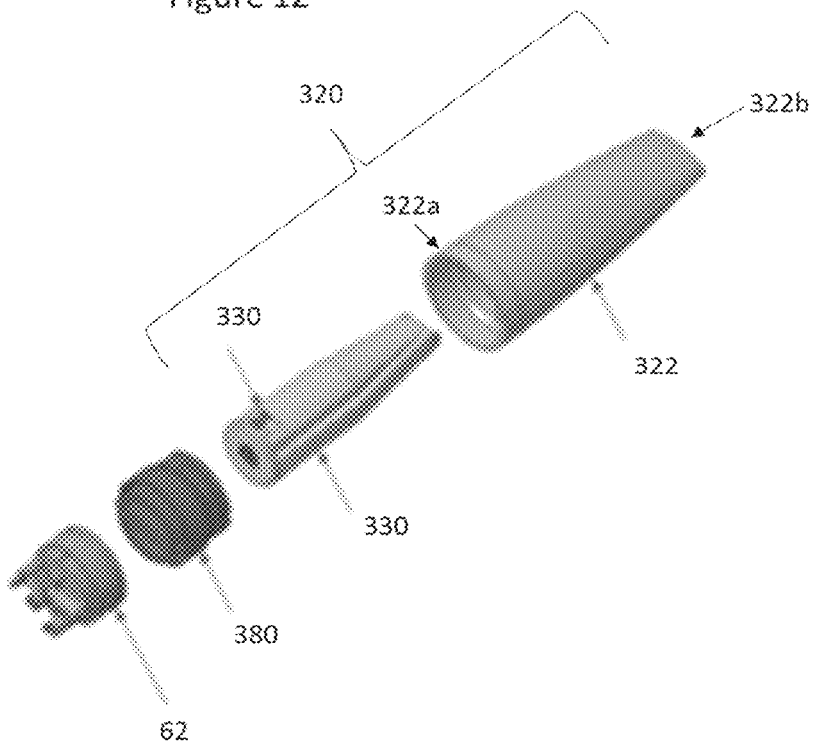
FIG. 12 illustrates an exploded perspective view of a cartridge assembly, together with a first portion of an aerosol-generating device and an adaptor member, in accordance with an example embodiment.

FIG. 12 illustrates an exploded perspective view of a cartridge assembly, together with a first portion of an aerosol-generating device and an adaptor member, in accordance with an example embodiment. As shown, the cartridge assembly 320 according to a third example embodiment. FIG. 12 also illustrates a first portion 62 of an aerosol-generating device 40 and an adaptor member 380.

The cartridge assembly 320 includes a cartridge 330 and a housing 322 in the form of a mouthpiece. Unlike the first and second embodiments, the cartridge assembly of the third embodiment does not include an insert member 170. Instead, the cartridge 330 is configured to be directly inserted into the housing 322.

Figure 13:
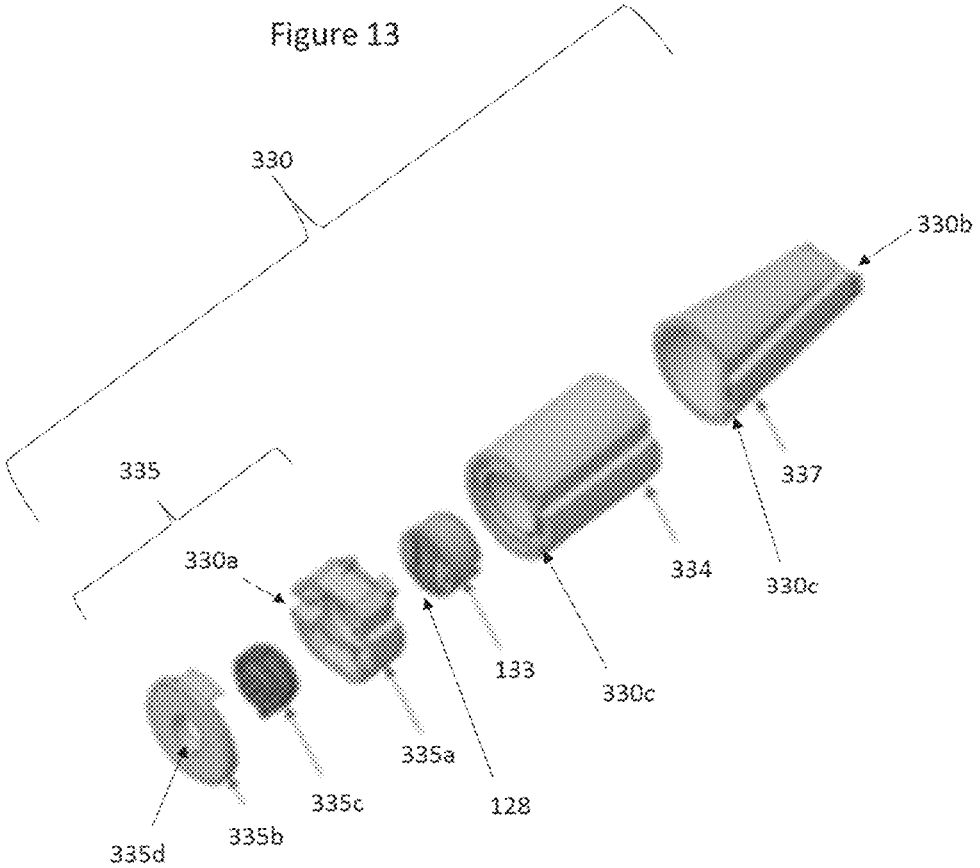
FIG. 13 illustrates an exploded perspective view of the cartridge of FIG. 12, in accordance with an example embodiment.

FIG. 13 illustrates an exploded perspective view of the cartridge of FIG. 12, in accordance with an example embodiment. As shown, as with the cartridges 130 and 230 of the first and second embodiments, the cartridge 330 of the third embodiment includes a heating assembly comprising a flat liquid permeable mesh heating element 128 held onto a heater cap 133. The heating assembly is arranged to fit within a device end of a main body 334 of the cartridge 330, and be in fluid communication with a storage container within the main body 334 of the cartridge, which holds liquid aerosol-forming substrate. The cartridge 130 also includes a mouth end portion 337. The mouth end portion may define at least part of the storage container. The mouth end portion may be substantially pointed. The mouth end portion 337 may be integrally formed with the main body 334, or may be a discrete element, which is connected to the main body 334.

The cartridge 230 also includes a cartridge cap 335. The cap 335 includes a base 335*a* which is configured to connect to the cartridge main body 334 by a snap fit engagement. The cap 335 also includes a top 335*b*, which is configured to connect to, and at least partially cover, the base 335*a*. The base and top together define a cartridge air inlet 330*a* for air to flow into the cartridge and across the top of the heating element 128. The air can then continue to flow through a channel 330*c*, which passes along one side of the cartridge main body 334 and cartridge mouth end portion 337. At the end of the channel 330*c* is a cartridge air outlet 330*b*. Air can therefore flow through the cartridge 330 from the air inlet 330*a* to the cartridge air outlet 330*b*, via the space above the heating element 128 and via the cartridge air channel 330*c*.

Unlike the cartridges 130 and 230 of the first and second embodiments, the main body 334 of the cartridge 330 of the third embodiment is not configured to move relative to the housing 322 once the cartridge 330 has been inserted into the housing 122. Instead, the main body 334 remains in a fixed position, both axially and radially. In this position, the cartridge air inlet 330*a* is axially and radially aligned with the housing air inlet 322*a*, and the cartridge air outlet 330*b* is axially and radially aligned with the housing air outlet 322*b*. Air can therefore flow between the cartridge air inlet 330*a* and the housing air inlet 322*a*. Air can also low between the cartridge air outlet 330*b* and the housing air outlet 322*b*.

Figure 14B:
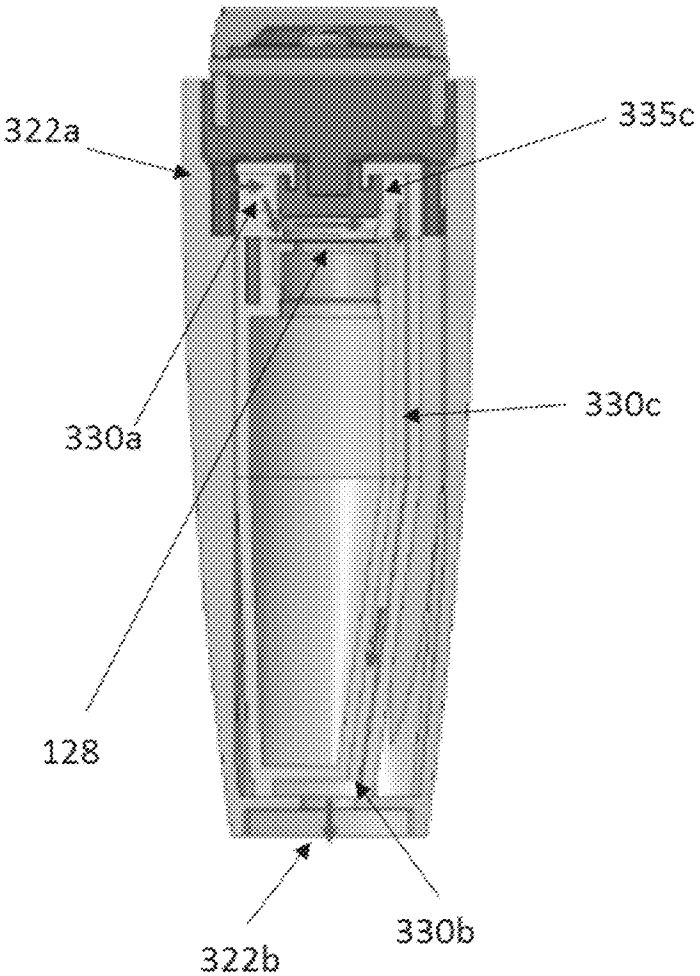
FIG. 14B illustrates a sectional view of the cartridge assembly of FIG. 12, in accordance with an example embodiment.
Figure 14A:
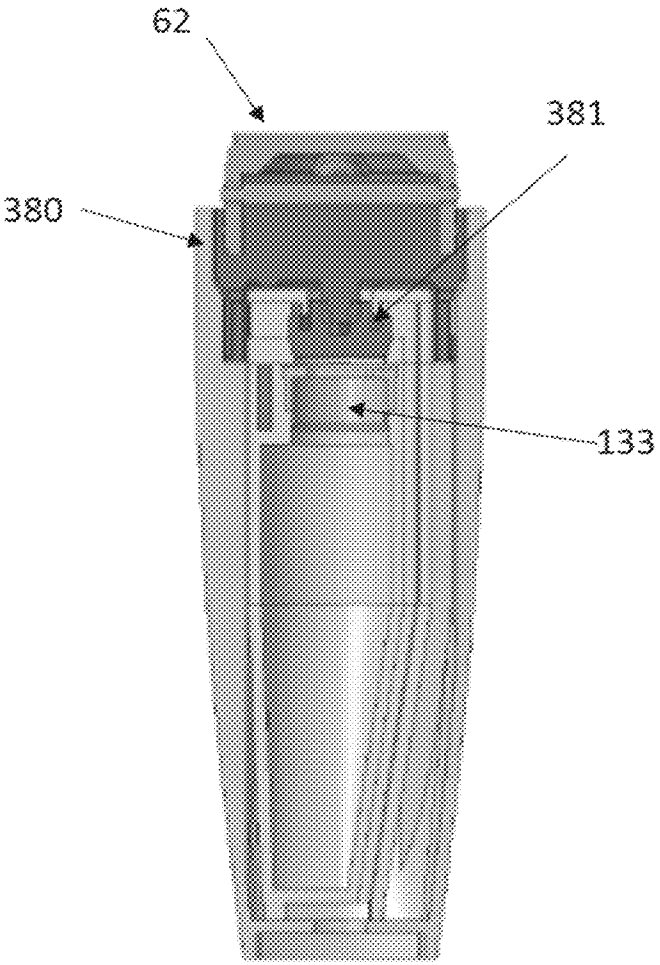
FIG. 14A illustrates a sectional view of the cartridge assembly of FIG. 12, in accordance with an example embodiment.

FIG. 14A illustrates a sectional view of the cartridge assembly of FIG. 12, in accordance with an example embodiment. As shown, in order to provide a blocking mechanism for air flow in the third embodiment, the cartridge cap 335*a* includes a threaded member 335*c* disposed between the cartridge cap base 335*a* and cartridge cap top 335*b*. The threaded member 335*c* is configured to move between a first position, as shown in FIG. 14A, and a second position, as shown in FIG. 14B. When the threaded member 335*c* is in the first position, it provides a sealed enclosure about the heating element 128. Consequently, the threaded member 335*c* blocks air from flowing from the cartridge air inlet 330*a* to the heating element 128. It also blocks air from flowing from the cartridge air channel 330*c* to the heating element 128. Therefore, when the threaded member 335*c* is in the first position, air is blocked from flowing from the housing air inlet 322*a* to the housing air outlet 322*b*, via the cartridge air inlet 330*a*, the fluid-permeable heating element 128, and the cartridge air outlet 330*b*.

FIG. 14B illustrates a sectional view of the cartridge assembly of FIG. 12, in accordance with an example embodiment. As shown, in the second position, the threaded member 335*c* is spaced away from the heating element 128, such that a flow path exists between the threaded member 335*c* and the heating element 128. Air can therefore flow from the cartridge air inlet 330*a*, across the heating element 128 and on to the cartridge air channel 330*c*. Therefore, when the threaded member 335*c* is in the second position, an unrestricted airflow path exists from the housing air inlet 322*a* to the housing air outlet 322*b*, via the cartridge air inlet 330*a*, the fluid-permeable heating element 128, and the cartridge air outlet 330*b*.

With references to FIGS. 14A and 14B, the following describes how the threaded member 335*c* can be moved between its first and second positions.

As shown in FIG. 14A, when the device 40 is first connected to the cartridge assembly 320, the threaded member 335*c* is in the first position. The cartridge 330 is held within the housing in a fixed position relative to the housing 322. That is, the cartridge main body 324 cannot rotate relative to the housing 322.

The adaptor member is attached to the device so that the adaptor member cannot rotate relative to the device.

The adaptor member 380 is then inserted into the device end of the housing 322 to the position shown in FIG. 14A. The adaptor member 380 can form a snap fit engagement with the housing 322 so that the adaptor member 380 and device 40 are axially fixed with respect to the housing 322, yet free to rotate relative to the housing 322. Alternatively, the adaptor member 380 can include a bayonet locking mechanism similar to that of the second embodiment, so that the adaptor member 380 can be held in an axially fixed position with respect to the housing 322, yet free to rotate relative to the housing 322, by at least some degrees.

A protruding part 381 of the adaptor member 380 extends through an aperture 335*d* in the top 330*b* of the cartridge cap 335. The protruding part 381 engages with a surface of a recessed section of the threaded member 335*c*, in a similar manner to how a screwdriver tip engages with the head of a screw. The outer surface of the threaded member 335*c* has a first thread, which is engaged with a second thread on the inner surface of the cartridge cap base 335*a*. This arrangement means that as the device 40 and adaptor member 380 rotate relative to the cartridge body 334 and housing 322, the protruding part 381 of the adaptor member 380 engages with the inner surface of the threaded member 335*c* and causes the threaded member to move axially with respect to the rest of the cartridge 330. In particular, the threads of the threaded member 380 and cartridge cap base 335*a*, are arranged such that clockwise rotation of the device 40 relative to the housing 322 causes the threaded member 335*c* to move towards the device 40, and away from the heating element 128. After approximately 90 degrees of clockwise rotation, the threaded member 335*c* is spaced away from the heating element 128, such that a flow path exists between the threaded member 335*c* and the heating element 128, as shown in FIG. 14B. At this point, air is free to flow from the cartridge air inlet 330*a*, across the heating element 128 and on to the cartridge air channel 330*c*. The device 40 and cartridge assembly 320 can be used to create an aerosol that they can be drawn through an outlet of the device 40.

The device 40 and cartridge assembly 320 can be rotated anti-clockwise with respect to the housing 322, by around 90 degrees. This causes the threaded member 335*c* to be rotated anti-clockwise relative to the rest of the cartridge 330, and therefore moved towards the heating element 128. The threaded member can therefore revert to the position shown in FIG. 14A and thus blocks air from flowing to heating element 128.

In each of the first, second and third embodiments described above with respect to the drawings, the ability to move at least a part of the cartridge from a first position to a second position, such that air flow to the heating element 128 can be selectively blocked or opened, means that leakage of liquid aerosol-forming substrate from the heating element to the exterior of the cartridge assembly, can be reduced. This means that when the cartridge assembly is not being used to produce an aerosol, a consumer can be more confident that there will not be any leakage of any liquid aerosol-forming substrate. However, when the consumer is ready to use the aerosol-generating system, they can readily move part of the cartridge so that the heating element 128 is exposed to airflow, and consequently able to produce aerosol that can be released to the consumer.

The specific embodiments and examples described above illustrate but do not limit the example embodiments. It is to be understood that other embodiments may be made, and the specific embodiments and examples described herein are not exhaustive.

We claim:

1. A cartridge assembly for an aerosol-generating system, the cartridge assembly comprising:

a housing having a mouth end and an opposed device end configured to connect to an aerosol-generating device, a housing air outlet provided at the mouth end of the housing, and a housing air inlet provided upstream of the housing air outlet; and a cartridge disposed in the housing, the cartridge including, a heating element disposed within the cartridge;

a cartridge air inlet;

a cartridge air outlet, the cartridge air inlet and the cartridge air outlet defining a cartridge airflow path via the heating element;

wherein, at least a portion of the cartridge is configured to be movable between a first position, in which the cartridge air inlet via the cartridge airflow path and the heating element to the cartridge air outlet are sealed from at least one of the housing air inlet or the housing air outlet; and a second position, in which the cartridge airflow path is open and connected to an external atmosphere via the housing air inlet and the housing air outlet.

2. The cartridge assembly according to claim 1, wherein the housing further includes a storage container containing a supply of liquid aerosol-forming substrate, and wherein when the cartridge is inserted into the housing, the heating element is positioned across an opening in the storage container.

3. The cartridge assembly according to claim 1, wherein the cartridge further includes a storage container within the cartridge, said storage container containing a supply of liquid aerosol-forming substrate, and wherein the heating element is positioned across an opening in the storage container.

4. The cartridge assembly according to claim 1, further comprising a biasing member configured to move the cartridge towards the first position.

5. The cartridge assembly according to claim 1, wherein the at least a portion of the cartridge is configured to be in the second position when the housing connects to the aerosol-generating device.

6. The cartridge assembly according to claim 1, further comprising:

an insert member disposed between the cartridge and the housing, wherein the insert member includes an insert member air inlet and an insert member air outlet, and wherein when the cartridge is in the first position, the insert member air inlet is misaligned with the cartridge air inlet and the insert member air outlet is misaligned with the cartridge air outlet; and wherein when the cartridge is in the second position, the insert member air inlet is aligned with the cartridge air inlet and the insert member air outlet is aligned with the cartridge air outlet.

7. The cartridge assembly according to claim 1, wherein the cartridge includes a cartridge main body configured to house the heating element, and wherein the cartridge air inlet includes at least one opening in the cartridge main body of the cartridge;

the cartridge air outlet includes at least one opening in the cartridge main body of the cartridge; or both the cartridge air inlet includes at least one opening in the cartridge main body of the cartridge, and the cartridge air outlet comprises at least one opening in the cartridge main body of the cartridge.

8. The cartridge assembly according to claim 7, wherein the cartridge includes a cartridge cap configured to connect to the cartridge main body, and cover the heating element.

9. The cartridge assembly according to claim 8, wherein the cartridge cap is provided with electrical connectors to form an electrical connection with the heating element.

10. The cartridge assembly according to claim 8, wherein the cartridge cap includes a cartridge cap base configured to connect to the cartridge main body, and a cartridge cap top, which is configured to connect to, and at least partially cover, the cartridge cap base, and wherein the cartridge cap base and cartridge cap top together define the cartridge air inlet for air to flow into the cartridge and across the top of the heating element.

11. The cartridge assembly according to claim 10, wherein the cartridge cap further includes a threaded member disposed between the cartridge cap base and the cartridge cap top, the threaded member being configured to move between a first cap position in which the threaded member provides a sealed enclosure for the heating element; and a second cap position in which the threaded member is spaced away from the heating element to define an airflow channel for air to flow between the heating element and the cartridge air inlet, the cartridge air outlet, or both.

12. The cartridge assembly according to claim 1, wherein the cartridge includes a locking system for temporarily affixing the cartridge to the housing.

13. A cartridge for an aerosol-generating system, the cartridge comprising:

a storage container within the cartridge, the storage container containing a supply of liquid aerosol-forming substrate;

a heating element disposed within the cartridge and positioned across an opening in the storage container; and, a cartridge air inlet and a cartridge air outlet, defining a cartridge airflow path, the heating element separating the storage container from the cartridge airflow path;

at least a portion of the cartridge is configured to move within the cartridge between a first position, in which air from the cartridge air inlet is blocked from flowing to the cartridge air outlet and the supply of liquid aerosol-forming substrate is sealed within the cartridge; and a second position, in which an airflow path is open from the cartridge air inlet to the cartridge air outlet, via the heating element.

14. The aerosol-generating system comprising a cartridge assembly according to claim 13, and an aerosol-generating device comprising a power supply and control electronics, wherein the cartridge assembly is configured to connect to the aerosol-generating device.

15. A kit for an aerosol-generating system, the kit comprising:

a housing having a mouth end and an opposed device end configured to connect to an aerosol-generating device, a housing air outlet provided at the mouth end of the housing, and a housing air inlet provided upstream of the housing air outlet, the housing air inlet and the housing air outlet defining a housing airflow path; and a cartridge configured to be inserted into the housing, the cartridge including, a heating element disposed within the cartridge;

a cartridge air inlet;

a cartridge air outlet, the cartridge air inlet and the cartridge air outlet defining a cartridge airflow path;

based on the cartridge being inserted into the housing, at least a portion of the cartridge is configured to be movable between a first position, in which the cartridge air inlet via the cartridge airflow path and the heating element to the cartridge air outlet are sealed from at least one of the housing air inlet or the housing air outlet; and a second position, in which the cartridge airflow path is open and connected to the housing airflow path such that the housing airflow path is unrestricted from the housing air inlet to the housing air outlet.

16. The cartridge assembly according to claim 1, wherein the cartridge includes a guide mechanism configured to retain the cartridge within the housing and restrict axial movement of the cartridge within the housing.

* * * * *